US012691346B2

(12) United States Patent
Janus et al.

(10) Patent No.: US 12,691,346 B2
(45) Date of Patent: Jul. 28, 2026

(54) GOLF CLUB HEAD BENDING SYSTEM AND ASSOCIATED METHOD

(71) Applicant: Taylor Made Golf Company, Inc., Carlsbad, CA (US)

(72) Inventors: Rafal Janus, Basingstoke (GB); Lewis Beckett, Basingstoke (GB); Mondher Latiri, Kaohsiung City (TW); Aimen Latiri, Kaohsiung City (TW)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 282 days.

(21) Appl. No.: 18/431,446

(22) Filed: Feb. 2, 2024

(65) Prior Publication Data

US 2024/0261649 A1 Aug. 8, 2024

Related U.S. Application Data

(60) Provisional application No. 63/443,330, filed on Feb. 3, 2023.

(51) Int. Cl.
*A63B 60/42* (2015.01)
*A63B 53/02* (2015.01)

(52) U.S. Cl.
CPC ..... *A63B 60/42* (2015.10); *A63B 53/023* (2020.08)

(58) Field of Classification Search
CPC ..... B21D 3/10; B21D 3/14; B21D 3/16
See application file for complete search history.

(56) References Cited

U.S. PATENT DOCUMENTS

| | | | | |
|---|---|---|---|---|
| 4,622,836 | A | 11/1986 | Long et al. | |
| 6,871,414 | B2 * | 3/2005 | Burney | A63B 60/42 33/549 |
| 11,554,302 | B1 * | 1/2023 | Power | A63B 60/42 |
| 12,330,031 | B2 * | 6/2025 | Ryan | A63B 71/0622 |
| 2014/0302946 | A1 | 10/2014 | Rae et al. | |

OTHER PUBLICATIONS

Search Report from United Kingdom Intellectual Property Office for GB Patent Application No. GB201514.1 dated Jul. 22, 2024.
Procedure for Measuring the Club Head Size of Wood Clubs, United States Golf Association and R&A Rules Limited, USGA-TPX3003, Nov. 21, 2003, pp. 1-6.

* cited by examiner

*Primary Examiner* — Matthew Katcoff
(74) *Attorney, Agent, or Firm* — Massey Bean & Lewis

(57) ABSTRACT

A bending system for bending a golf club head includes a clamping assembly, configured to clamp the golf club head. The bending system also includes a position sensing device, selectively attachable to a golf club. The position sensing device includes a sensor array comprising an accelerometer and a gyroscope. The bending system further includes an electronic controller, configured to determine at least one of a lie or a loft of the golf club head, when the position sensing device is selectively attached to the golf club and the golf club head is clamped by the clamping assembly, based at least partially on sensor data received from the accelerometer and the gyroscope.

23 Claims, 24 Drawing Sheets

GOLF CLUB HEAD BENDING SYSTEM AND ASSOCIATED METHOD

CROSS-REFERENCE TO RELATED APPLICATION

This application claims the benefit of U.S. Provisional Patent Application No. 63/443,330, filed Feb. 3, 2023, which is incorporated herein by reference in its entirety.

FIELD

This disclosure relates generally to golf club manufacturing, and more particularly to systems and methods for bending a hosel of a golf club head relative to a strike face of the golf club head.

BACKGROUND

Conventional golf club head bending techniques and systems can require a complicated and time-consuming calibration and set up of a bending machine before bending of a golf club head can take place. Additionally, ensuring a golf club head has been properly bent to a desired loft and/or lie can require complex calculations, complex measurement techniques, and expensive measurement components. Furthermore, conventional bending machines are big, bulky, and heavy, which makes storage, transportation, and operation difficult.

SUMMARY

The subject matter of the present application has been developed in response to the present state of the art, and in particular, in response to the shortcomings of conventional systems for bending golf club heads. Conventional systems require extensive use of mechanical protractors and scales, which is a time-consuming process, is prone to manipulation errors, and does not provide real-time feedback. Accordingly, the subject matter of the present application has been developed to provide examples of a golf club head bending system that overcome at least some of the shortcomings of conventional systems.

The following is a non-exhaustive list of examples, which may or may not be claimed, of the subject matter, disclosed herein.

Disclosed herein is a bending system for bending a golf club head. The bending system includes a clamping assembly, configured to clamp the golf club head. The bending system also includes a position sensing device, selectively attachable to a golf club. The position sensing device includes a sensor array including an accelerometer and a gyroscope. The bending system further includes an electronic controller, configured to determine at least one of a lie or a loft of the golf club head, when the position sensing device is selectively attached to the golf club and the golf club head is clamped by the clamping assembly, based at least partially on sensor data received from the accelerometer and the gyroscope. The preceding subject matter of this paragraph characterizes example 1 of the present disclosure.

The clamping assembly includes a pre-clamp magnet configured to magnetically attach to a strike face of the golf club head. The preceding subject matter of this paragraph characterizes example 2 of the present disclosure, wherein example 2 also includes the subject matter according to example 1, above.

The clamping assembly further includes a primary clamp, configured to clamp the golf club head at a topline portion and a sole of the golf club head when the strike face is magnetically attached to the pre-clamp magnet, and a secondary clamp, configured to clamp the golf club head at a rearward portion and the strike face when the strike face is magnetically attached to the pre-clamp magnet. The preceding subject matter of this paragraph characterizes example 3 of the present disclosure, wherein example 3 also includes the subject matter according to example 2, above.

The primary clamp includes two sole-support pads that support the sole of the golf club head when the strike face is magnetically attached to the pre-clamp magnet, and that are movable relative to the pre-clamp magnet to accommodate a size and/or a shape of the sole of the golf club head. The preceding subject matter of this paragraph characterizes example 4 of the present disclosure, wherein example 4 also includes the subject matter according to example 3, above.

The two sole-support pads are translationally movable toward and away from the pre-clamp magnet. The preceding subject matter of this paragraph characterizes example 5 of the present disclosure, wherein example 5 also includes the subject matter according to example 4, above.

The primary clamp includes a first jaw, which supports the topline of the golf club head, and a second jaw, which supports the sole of the golf club head. The first jaw is pivotable and translationally movable toward and away from the second jaw. The preceding subject matter of this paragraph characterizes example 6 of the present disclosure, wherein example 6 also includes the subject matter according to any of examples 3-5, above.

The secondary clamp includes an end plate, elastomeric pads spaced apart from each other and fixed to the end plate, an actuator, and a pliable coupling that couples the actuator to the end plate. The preceding subject matter of this paragraph characterizes example 7 of the present disclosure, wherein example 7 also includes the subject matter according to any of examples 3-6, above.

The clamping assembly further includes a camera assembly. The pre-clamp magnet includes an aperture through which a portion of the strike face is viewable when the strike face is magnetically attached to the pre-clamp magnet. The camera assembly is configured to capture an image of the portion of the strike face viewable through the aperture. The preceding subject matter of this paragraph characterizes example 8 of the present disclosure, wherein example 8 also includes the subject matter according to any of examples 2-7, above.

The electronic controller is configured to determine whether the golf club head is squarely attached to the pre-clamp magnet based on the image captured by the camera assembly. The preceding subject matter of this paragraph characterizes example 9 of the present disclosure, wherein example 9 also includes the subject matter according to example 8, above.

The clamping assembly includes a toe stop configured to engage a toe of the golf club head when the golf club head is clamped by the clamping assembly. The toe stop is movable in a direction parallel to a heel-to-toe direction of the golf club head. The preceding subject matter of this paragraph characterizes example 10 of the present disclosure, wherein example 10 also includes the subject matter according to any of examples 1-9, above.

The position sensing device includes a sensor module that is selectively attachable to a shaft of the golf club head at a location proximate a hosel of the golf club head. The sensor module includes a shaft attachment portion that is configured to attach to the shaft with a snap fit. The preceding subject matter of this paragraph characterizes example 11 of the present disclosure, wherein example 11 also includes the subject matter according to any of examples 1-10, above.

The shaft attachment portion includes a first retention arm and a second retention arm. When the shaft attachment portion is attached to the shaft, the first retention arm is spaced apart from the second retention arm along a central axis of the shaft. The preceding subject matter of this paragraph characterizes example 12 of the present disclosure, wherein example 12 also includes the subject matter according to example 11, above.

Each one of the first retention arm and the second retention arm includes a shaft retention channel. The preceding subject matter of this paragraph characterizes example 13 of the present disclosure, wherein example 13 also includes the subject matter according to example 12, above.

The second retention arm is oppositely oriented relative to the first retention arm. The preceding subject matter of this paragraph characterizes example 14 of the present disclosure, wherein example 14 also includes the subject matter according to example 13, above.

The first retention arm and the second retention arm are flexible relative to each other. The preceding subject matter of this paragraph characterizes example 15 of the present disclosure, wherein example 15 also includes the subject matter according to example 14, above.

The sensor array is fixed relative to the shaft attachment portion. The preceding subject matter of this paragraph characterizes example 16 of the present disclosure, wherein example 16 also includes the subject matter according to any of examples 11-15, above.

The position sensing device includes a bending tool. The preceding subject matter of this paragraph characterizes example 17 of the present disclosure, wherein example 17 also includes the subject matter according to any of examples 1-16, above.

The sensor array further includes a magnetometer. The preceding subject matter of this paragraph characterizes example 18 of the present disclosure, wherein example 18 also includes the subject matter according to any of examples 1-17, above.

The position sensing device includes a wireless transceiver that is configured to wirelessly transmit the sensor data to the electronic controller. The preceding subject matter of this paragraph characterizes example 19 of the present disclosure, wherein example 19 also includes the subject matter according to any of examples 1-18, above.

The position sensing device further includes an onboard power source and the accelerometer and the gyroscope are powered from electrical energy received from the onboard power source. The preceding subject matter of this paragraph characterizes example 20 of the present disclosure, wherein example 20 also includes the subject matter according to any of examples 1-19, above.

The position sensing device captures the sensor data and the electronic controller determines the at least one of the lie and the loft of the golf club head in real time as the hosel is bent relative to the strike face. The preceding subject matter of this paragraph characterizes example 21 of the present disclosure, wherein example 21 also includes the subject matter according to any of examples 1-20, above.

The bending system a further includes a graphical user interface configured to display a current position of the position sensing device in real time relative to a target position of the position sensing device. The preceding subject matter of this paragraph characterizes example 22 of the present disclosure, wherein example 22 also includes the subject matter according to any of examples 1-21, above.

The position sensing device includes a bending tool. The bending tool includes a bar and a bit attached to an end of the bar. The bit is configured to engage and retain a hosel of the golf club head. The sensor array is attached to the bar of the bending tool. The preceding subject matter of this paragraph characterizes example 23 of the present disclosure, wherein example 23 also includes the subject matter according to any of examples 1-22, above.

The bar includes a hollow portion that defines an interior cavity. The sensor array is within the interior cavity. The preceding subject matter of this paragraph characterizes example 24 of the present disclosure, wherein example 24 also includes the subject matter according to example 23, above.

The bending system further includes a clamping-assembly sensor module that is selectively attachable to the clamping assembly and includes a second sensor array having an accelerometer and a gyroscope. The preceding subject matter of this paragraph characterizes example 25 of the present disclosure, wherein example 25 also includes the subject matter according to any of examples 1-24, above.

The bending system includes a plurality of position sensing devices. The preceding subject matter of this paragraph characterizes example 26 of the present disclosure, wherein example 26 also includes the subject matter according to any of examples 1-25, above.

One of the plurality of position sensing devices includes a sensor module that is selectively attachable to a shaft of the golf club head at a location proximate the hosel of the golf club head. The sensor module includes a shaft attachment portion that is configured to attach to the shaft with a snap fit. Another one of the plurality of position sensing devices includes a bending tool that includes a bar and a bit attached to an end of the bar. The bit is configured to engage and retain a hosel of the golf club head. The sensor array is attached to the bar of the bending tool. The preceding subject matter of this paragraph characterizes example 27 of the present disclosure, wherein example 27 also includes the subject matter according to example 26, above.

Further disclosed herein is a method of bending a golf club head. The method includes a step of clamping the golf club head in a clamping assembly. The method also includes a step of attaching a position sensing device to a golf club including the golf club head. The method additionally includes a step of setting a position of the position sensing device on the golf club as an initial position associated with an initial loft and an initial lie of the golf club head. The method also includes a step of bending the hosel relative to a strike face of the golf club head. The method further includes a step of detecting a new position of the position sensing device relative to the initial position based on sensor data captured by at least one electronic sensor of the position sensing device as the hosel is bent. The method additionally includes a step of determining at least one of a new lie and a new loft of the golf club head, as the hosel is bent, based on a difference between the new position of the position sensing device and the initial position of the position sensing device. The preceding subject matter of this paragraph characterizes example 28 of the present disclosure.

The method further includes a step of magnetically attaching the strike face of the golf club head to a pre-clamp magnet. The golf club head is clamped in the clamping assembly when the strike face is magnetically attached to the pre-clamp magnet. The preceding subject matter of this paragraph characterizes example 29 of the present disclosure, wherein example 29 also includes the subject matter according to example 28, above.

The method further includes adjusting an orientation of the strike face, relative to the pre-clamp magnet, when the strike face is magnetically attached to the pre-clamp magnet. The preceding subject matter of this paragraph characterizes example 30 of the present disclosure, wherein example 30 also includes the subject matter according to example 29, above.

The method further includes capturing a digital image of the strike face through an aperture in the pre-clamp magnet and digitally superimposing indicia, representing scorelines, over the digital image of the strike face. The orientation of the strike face, relative to the pre-clamp magnet, is adjusted based on non-alignment of the indicia and scorelines of the strike face. The preceding subject matter of this paragraph characterizes example 31 of the present disclosure, wherein example 31 also includes the subject matter according to example 30, above.

The method further includes steps of determining a home position of the position sensing device and determining the initial loft and the initial lie of the golf club head based on a comparison between the home position and the initial position of the position sensing device. The preceding subject matter of this paragraph characterizes example 32 of the present disclosure, wherein example 32 also includes the subject matter according to any of examples 28-31, above.

The clamping assembly is pivotally attached to a frame. A calibration pin is attached to the frame so that the calibration pin does not move relative to the frame. The calibration pin has a known position relative to the frame. The step of determining the home position of the position sensing device includes attaching the position sensing device to the calibration pin. The position of the position sensing device on the golf club is based on a comparison between the home position and sensor data captured by the at least one electronic sensor of the position sensing device when the position sensing device is attached to the golf club. The preceding subject matter of this paragraph characterizes example 33 of the present disclosure, wherein example 33 also includes the subject matter according to example 32, above.

The position sensing device includes a sensor module. The he sensor module includes the at least one electronic sensor. The sensor module includes a shaft attachment portion. The step of attaching the position sensing device to the golf club includes attaching the shaft attachment portion of the sensor module to a shaft of the golf club retained by a hosel of the golf club at a location proximate the hosel of the golf club head. Attaching the position sensing device to the calibration pin includes attaching the shaft attachment portion of the sensor module to the calibration pin. The preceding subject matter of this paragraph characterizes example 34 of the present disclosure, wherein example 34 also includes the subject matter according to example 33, above.

The position sensing device includes a bending tool. The bending tool includes a bar and a bit attached to an end of the bar. The bit is configured to engage and retain a hosel of the golf club head. The at least one electronic sensor is attached to the bar of the bending tool. The step of attaching the position sensing device to the golf club includes attaching the bit of the bending tool to a hosel of the golf club. The step of bending the hosel relative to the strike face of the golf club head includes moving the bending tool relative to the strike face when the bit is attached to the hosel. Attaching the position sensing device to the calibration pin includes attaching the bit of the bending tool to the calibration pin. The preceding subject matter of this paragraph characterizes example 35 of the present disclosure, wherein example 35 also includes the subject matter according to any of examples 33-34, above.

The method further includes determining a home position of a clamping-assembly sensor module relative to the clamping assembly by attaching a pin attachment portion of the clamping-assembly sensor module to the calibration pin. The clamping-assembly sensor module includes at least one electronic sensor. The method also includes attaching the clamping-assembly sensor module to the clamping assembly. The method also includes determining a position of the clamping assembly based on a comparison between the home position of the clamping-assembly sensor module and sensor data captured by the at least one electronic sensor of the clamping-assembly sensor module when attached to the clamping assembly. The preceding subject matter of this paragraph characterizes example 36 of the present disclosure, wherein example 36 also includes the subject matter according to any of examples 33-35, above.

Additionally disclosed herein is a method of bending a golf club head. The method includes a step of clamping the golf club head in a clamping assembly. The method also includes a step of attaching a first position sensing device to a golf club including the golf club head. The method further includes a step of determining a first home position of the first position sensing device. The method additionally includes a step of attaching a second position sensing device to the golf club. The method also includes a step of determining a second home position of the second position sensing device. The method further includes a step of determining a first position of the first position sensing device based on a comparison between the first home position and first sensor data captured by at least one first sensor of the first position sensing device when attached to the golf club. The method also includes a step of determining a second position of the second position sensing device based on a comparison between the second home position and second sensor data captured by at least one second sensor of the second position sensing device. The method further includes a step of bending the hosel relative to a strike face of the golf club head. The method additionally includes a step of determining at least one of a change in a lie and a change in a loft of the golf club head, as the hosel is bent, based on a comparison between the first position of the first position sensing device and the second position of the second position sensing device. The preceding subject matter of this paragraph characterizes example 37 of the present disclosure.

The method further includes attaching a third position sensing device to the clamping assembly, determining a third home position of the third position sensing device, and determining a third position of the third position sensing device based on a comparison between the third home position and third sensor data captured by at least one third sensor of the third position sensing device when attached to the clamping assembly. The preceding subject matter of this paragraph characterizes example 38 of the present disclosure, wherein example 38 also includes the subject matter according to example 37, above.

The step of determining at least one of the change in the lie and the change in the loft of the golf club head, as the hosel is bent, is based on a triangulation of the first position of the first position sensing device, the second position of the second position sensing device, and the third position of the third position sensing device. The preceding subject matter of this paragraph characterizes example 39 of the present disclosure, wherein example 39 also includes the subject matter according to example 38, above.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only some embodiments of the subject matter and are not therefore to be considered to be limiting of its scope, the subject matter will be described and explained with additional specificity and detail through the use of the drawings.

FIG. 1F-2 is a perspective view of a sensor-module calibration pin and the clamping assembly of the golf club head bending system of FIG. 1A, shown with a sensor module attached to the sensor-module calibration pin, according to one or more examples of the present disclosure;

FIG. 2 is a perspective view of a golf club head bending system, shown with a golf club head clamped by the bending system and a bending tool engaged with a hosel of the golf club head, according to one or more examples of the present disclosure;

DETAILED DESCRIPTION

Figure 1A:
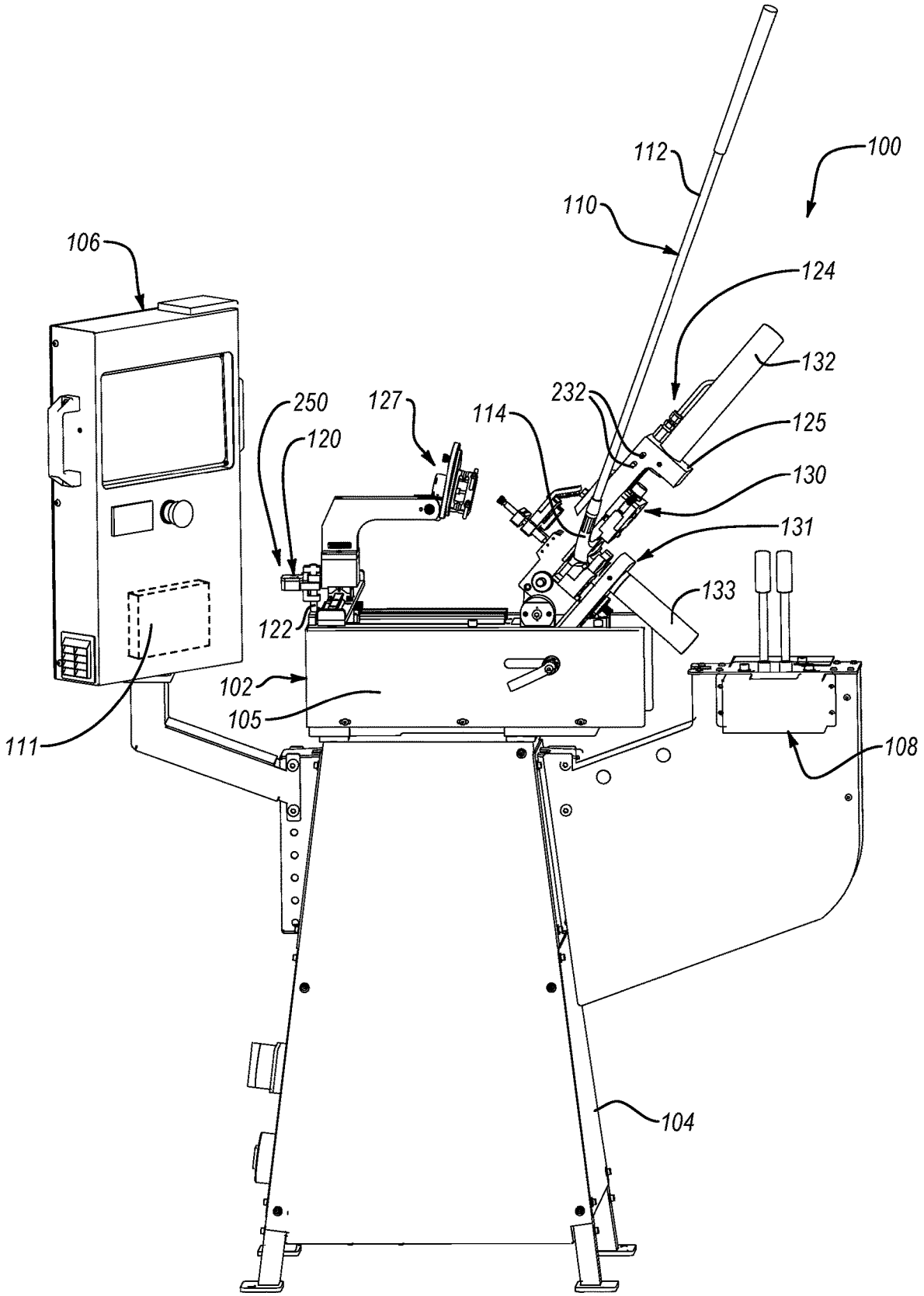
FIG. 1A is a perspective view of a golf club head bending system, according to one or more examples of the present disclosure.

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Golf club head bending machines are configured to bend the hosel of a golf club head relative to a strike face of the golf club head so that the golf club head has a desired loft and/or lie. The loft of a golf club head is the angle defined between the strike face of the golf club head and a ground plane when the golf club head is in a proper address position on the ground plane. The loft of the golf club head can also be associated with an axis of the hosel of the golf club head because the strike face lies in a plane that defines an angle relative to the axis of the hosel. The lie can be defined as the angle defined between the hosel axis and scorelines on the strike face.

U.S. Patent Application Publication No. 2014/0302946 A1 ('946 App), published Oct. 9, 2014, which is incorporated herein by reference in its entirety, describes a "reference position" (e.g., a proper address position) used to measure the various parameters discussed throughout this application. The reference or proper address position can be based on the procedures described in the United States Golf Association and R&A Rules Limited, "Procedure for Measuring the Club Head Size of Wood Clubs," Revision 1.0.0, (Nov. 21, 2003). The proper address position is the position of the golf club head when (1) supported on a ground plane; (2) a hosel axis of the club head is at a lie angle θ1 of 60° relative to the ground plane; and (3) the hosel axis lies within a plane (e.g., vertical plane) that is perpendicular to the ground plane.

Typically, golf club heads are manufactured to have a standard loft and lie determined by the manufacturers prior to manufacturing of the golf club heads. In other words, each golf club head in a set is initially made to have a standard loft and a standard lie associated with each golf club head in the set. Often, golfers may be desirous to modify the standard loft and/or the standard lie based on user preferences, such as, but not limited to, a desired look of the golf club head at address, characteristics of the user's swing, a desired ball flight or trajectory, and the like. Additionally, in some instances, such as due to manufacturing tolerances and imperfections, a golf club head that is made to have a standard loft and/or a standard lie may have an actual lie and/or actual loft that diverges from the standard. Bending golf club heads, after manufacturing, can be helpful to adjust the loft and/or lie of the golf club heads to meet the manufacturer's specifications or a user's preferences.

However, as presented above, conventional bending techniques and systems have various shortcomings. For example, calibrating and setting up a bending machine can be complicated and time consuming. Additionally, ensuring a golf club head has been properly bent to a desired loft and/or lie can require complex calculations, complex measurement techniques, and expensive measurement components. Furthermore, conventional bending machines are big, bulky, and heavy, which makes storage, transportation, and operation difficult.

Referring to FIGS. 1A-1K, according to some examples, a golf club head bending system 100 that overcomes one or more of the above-presented shortcomings of conventional systems is shown. The bending system 100 (i.e., the golf club head bending system 100) is configured to bend the hosel of a golf club head 114 relative to a strike face of the golf club head 114 in a forward-rearward direction so that the golf club head 114 has a desired loft (i.e., loft angle) and/or in a heel-toe direction so that the golf club head 114 has a desired lie (i.e., lie angle), which is different than an initial or original loft or lie. More specifically, the bending system 100 bends the hosel of the golf club head 114 relative to the strike face to adjust either or both of the loft and lie from an initial loft and lie to a desired loft and lie. Bending the hosel, relative to the strike face, about an axis parallel to a heel-to-toe direction on the golf club head adjusts a loft of the golf club head. In contrast, bending the hosel, relative to the strike face, about an axis parallel to a forward-to-rearward direction on the golf club head adjusts the lie of the golf club head.

Figure 1B:
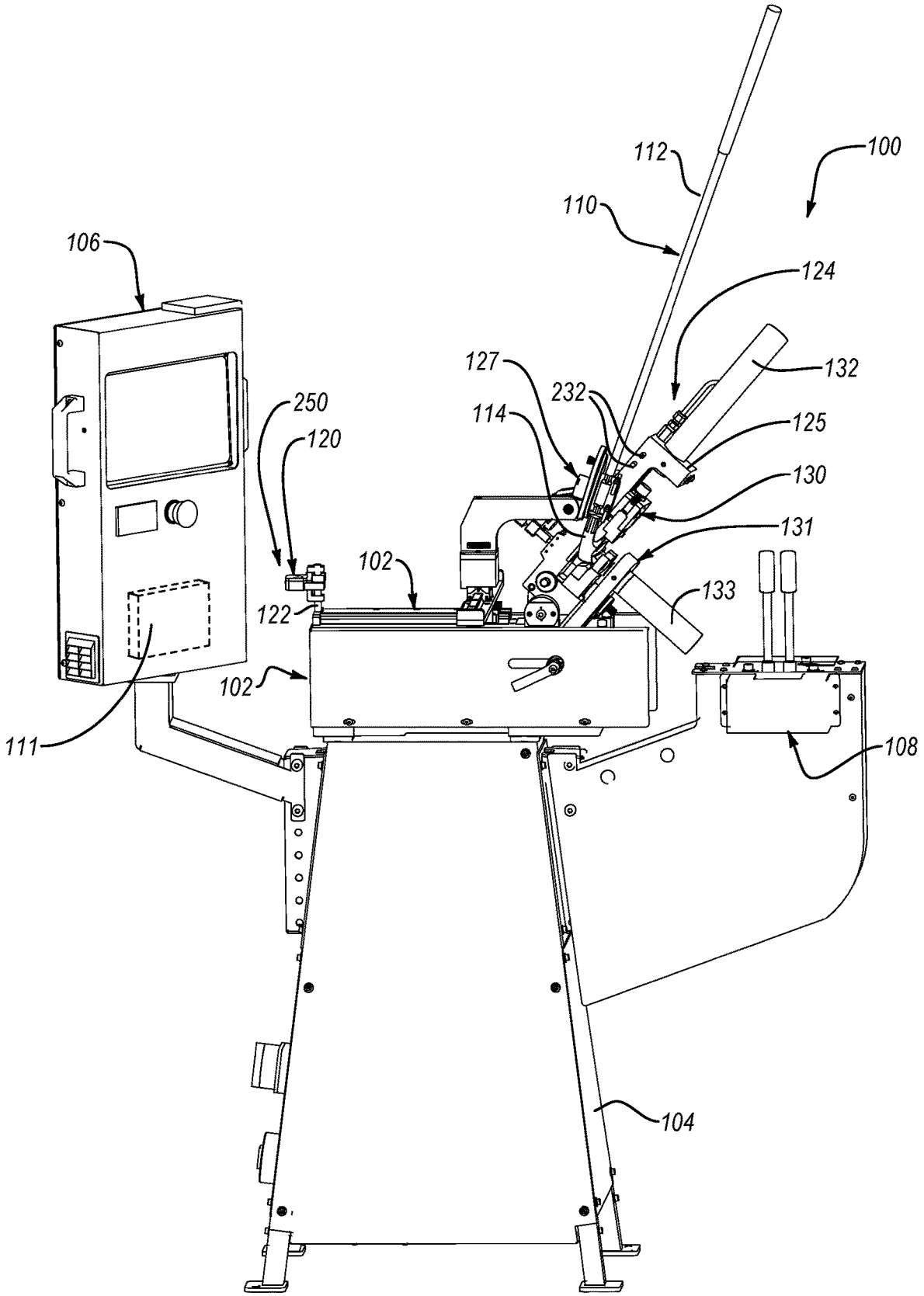
FIG. 1B is a perspective view of another golf club head bending system, according to one or more examples of the present disclosure.

As shown in FIGS. 1A and 1B, the bending system 100 includes a frame portion 102, a stand 104, a graphical user interface 106, and a control interface 108. The frame portion 102 is fixed to and supported on the stand 104, which can rest on a support surface, such as the ground (e.g., floor). In the illustrated example, the graphical user interface 106 includes an electronic display or monitor and is coupled to the stand 104. Additionally, in the illustrated example, the control interface 108 includes one or more user-engageable control hardware, such as one or more of buttons, knobs, levers, switches, handles, and the like. In some examples, the bending system 100 does not include the stand 104. For example, the frame portion 102, the graphical user interface 106, and the control interface 108 can be removed from the stand 104 and attached to any of various objects, such as a table, desk, counter, and the like.

The frame portion 102 includes a frame 105, a clamping assembly 124, a supplemental measurement assembly 127 (optional), and a sensor-module calibration pin 122 (also identified as calibration pin 122). The clamping assembly 124 is configured to secure the golf club head 114 in place during a hosel bending process and is rotatably coupled to the frame 105. The supplemental measurement assembly 127, which is not used in some examples, provides an analog measurement of the angle of the shaft 112 of the golf club 110 relative to a strike face of the golf club head 114 and is movable coupled to the frame 105. In FIG. 1A, the supplemental measurement assembly 127 is not engaged with the shaft 112, whereas in FIG. 1B, the supplemental measurement assembly 127 is shown attached to the shaft 112. The sensor-module calibration pin 122, which is also shown in FIG. 4B, is configured to help locate a position of a position sensing device 250 of the bending system 100 in a home position relative to the frame portion 102. As used herein, the position sensing device 250 is a device for measuring position along a plurality of axes and for measuring orientation relative to the plurality of axes (e.g., pitch, yaw, and roll). Accordingly, as used herein, the position of an object includes both the position of the object within a coordinate system defined by the plurality of axes and the orientation of the object relative to the plurality of axes.

Figure 1C:
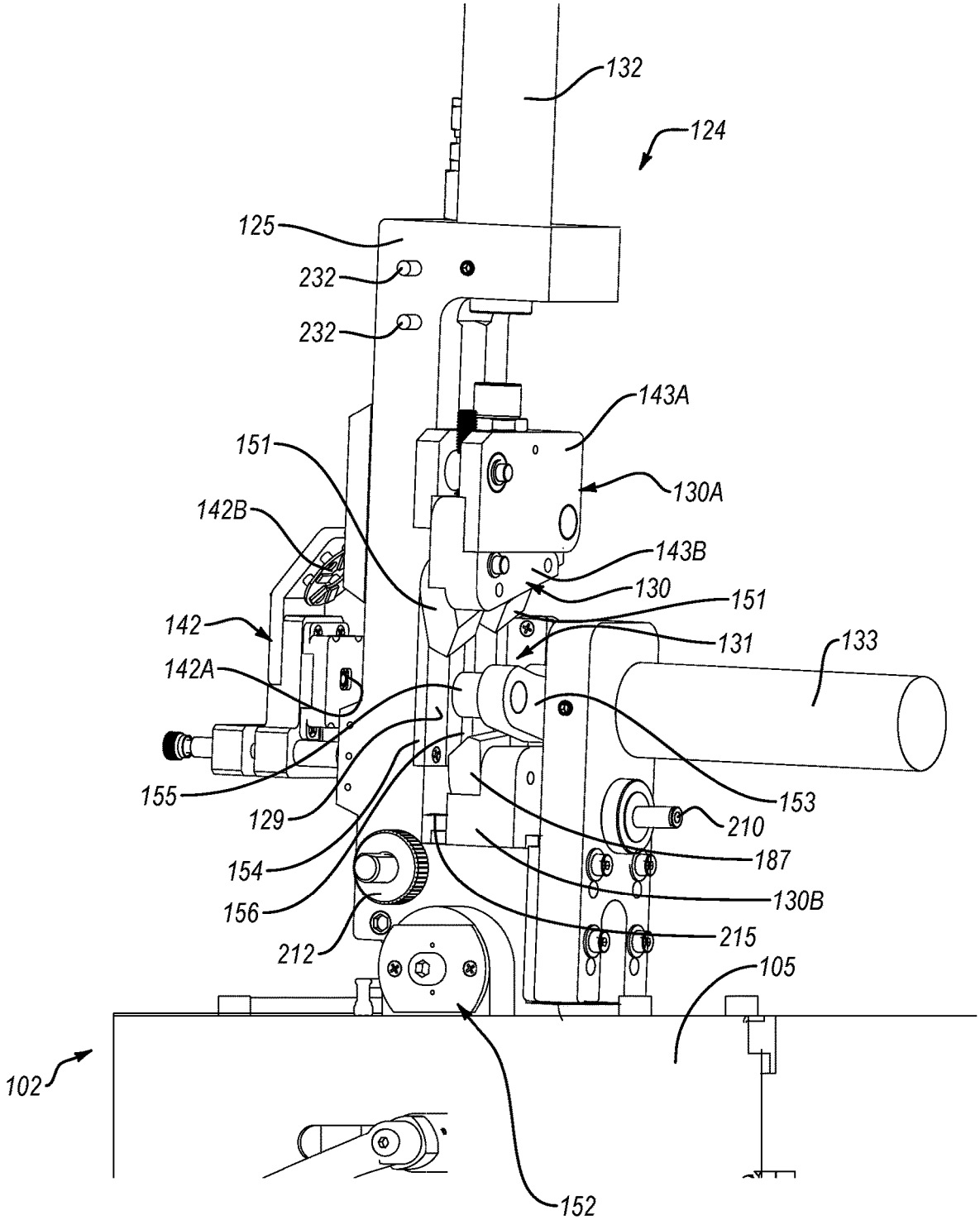
FIG. 1C is a perspective view of a clamping assembly of the golf club head bending system of FIG. 1A, according to one or more examples of the present disclosure.

Referring to FIGS. 1A-1K, 2, and 3, in some examples, the clamping assembly 124 includes a main body 125, a pre-clamp magnet 154 (see, e.g., FIGS. 1C and 1E) coupled to the main body 125, and a primary clamp 130 and a secondary clamp 131 that are coupled to and actuatable relative to the main body 125. It is recognized that in FIGS. 1H-1K, the main body 125 and the pre-clamp magnet 154 have been removed to more clearly show other features. As shown in FIG. 1C, the pre-clamp magnet 154, which can be a permanent magnet or an electromagnet, includes a flat interface surface 129 configured to magnetically attract and retain the strike face of the golf club head 114, which is made of a ferromagnetic material, such as steel. In some examples, the golf club head 114 is an iron-type golf club head that has a flat, or non-bulging, strike face. As such, the strike face of the golf club head 114 sits flush against the flat interface surface 129 of the pre-clamp magnet 154 when magnetically attached to the flat interface surface 129. The magnetic field or force generated by the pre-clamp magnet 154 is sufficient to retain the golf club head 114 against the pre-clamp magnet 154, without supplemental support, and to enable manual adjustment to the position of the golf club head 114 on the pre-clamp magnet 154 if needed. FIGS. 1G and 2 show an example of the golf club head 114 magnetically attached to the pre-clamp magnet 154.

Figure 3:
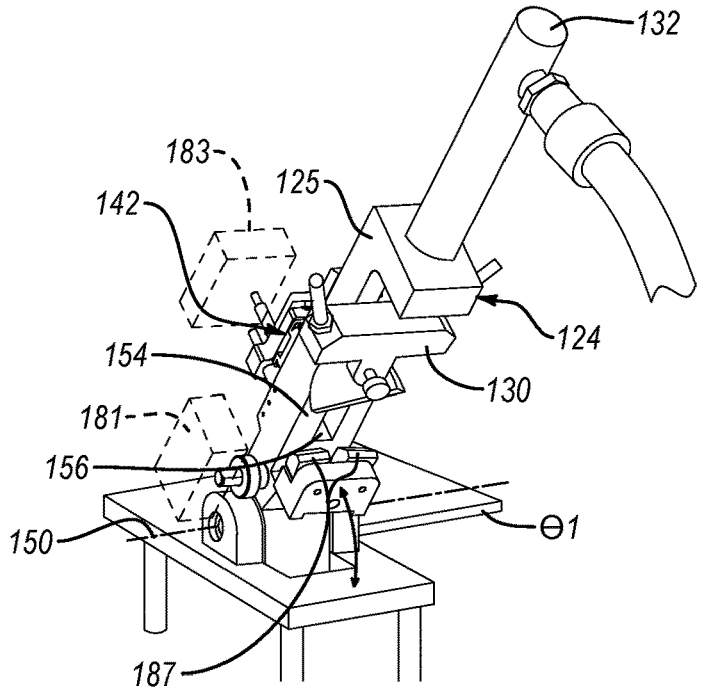
FIG. 3 is a perspective view of a golf club head bending system, according to one or more examples of the present disclosure.

Referring to FIGS. 1C and 3, the pre-clamp magnet 154 includes an aperture 156 through which the scorelines of the strike face can be viewed by a camera 142A of a camera assembly 142 when the golf club head 114 is magnetically attached to the pre-clamp magnet 154. The main body 125 also includes an aperture aligned with the aperture 156 of the pre-clamp magnet 154 so that the camera assembly 142 views the scorelines of the golf club head 114 through the aperture in the main body 125 and the aperture 156 of the pre-clamp magnet 154 when the golf club head 114 is magnetically attached to the flat interface surface 129 of the pre-clamp magnet 154.

The pre-clamp magnet 154 holds the golf club head 114 in place while the primary clamp 130 and the secondary clamp 131 are actuated to clamp the golf club head 114 relative to the main body 125. In this manner, an operator is not required to manually hold the golf club head 114 in place as the golf club head 114 is clamped, which enables the operator to use both hands, if needed, to clamp the golf club head 114 in place. In some examples, actuation of the primary clamp 130 and the secondary clamp 131 is controlled using the control interface 108. For example, the control interface 108 can include user-engageable control hardware (e.g., a first lever), which controls actuation of the primary clamp 130, and can include separate user-engageable control hardware (e.g., a second lever), which controls actuation of the secondary clamp 131.

Referring to FIGS. 1B-1K and 2, the primary clamp 130 includes a first jaw 130A and a second jaw 130B. The first jaw 130A is a translationally movable jaw and the second jaw 130B is a translationally fixed jaw in some examples. However, as shown, in certain examples, both the first jaw 130A and the second jaw 130B are translationally movable. In the illustrated example, the first jaw 130A is translationally movable in an upright direction (e.g., toward or away from the frame 105 and/or the second jaw 130B) and the second jaw 130B is translationally movable in a lateral direction (e.g., along the frame 105), which is perpendicular to the upright direction.

The first jaw 130A is actuated toward and away from the second jaw 130B via a hydraulic actuator 132. As shown in FIG. 1C, the first jaw 130A includes a fixed portion 143A and a hinged portion 143B. The hinged portion 143B is pivotably coupled to the fixed portion 143A via a hinge (e.g., pivot pin) such that the hinged portion 143B can pivot relative to the fixed portion 143A (see, e.g., direction arrows 177 in FIG. 1G). Adjustment or pivoting of the hinged portion 143B relative to the fixed portion 143A is accomplished by rotating an adjustment screw 143C. In some examples, the hinged portion 143B includes two or three topline clamp pads 151 each positioned to contact a different portion of a topline portion 116 (e.g., topline) of the golf club head 114 when clamped against the golf club head 114. The topline clamp pads 151 are made of a compliant or semi-rigid material, such as silicon, which at least partially deforms to conform to the shape of the topline 116 as the first jaw 130A is compressed against the topline. Additionally, in certain examples, the topline clamp pads 151 are rotatable, such as shown by directional arrows in FIGS. 1J and 1K, to further conform the topline clamp pads 151 to the topline 116 of the golf club head 114. The pivotable nature of the hinged portion 143B and the compliancy and rotatability of the topline clamp pads 151 promotes proper clamping of the topline 116 even when the golf club head 114 is not perfectly square when clamped, and accommodates clamping of different golf club heads having a variety of topline sizes and shapes.

The second jaw 130B includes one, two, or more sole-support pads 187, which are spaced apart from each other in a direction parallel to the flat interface surface of the pre-clamp magnet 154. Each one of the sole-support pads 187 includes an interface surface configured to support and retain a corresponding portion of the sole 117 of the golf club head 114. The interface surface is rounded (e.g., semi-circular shaped cross-section) in some examples and angled in other examples. In some examples, the sole-support pads 187 are floating so that they are movable (e.g., rotatable and/or translatable) relative to the main body 125. In one example, the sole-support pads 187 are attached to the main body 125, at least in part, by springs which enable retained movement of the sole-support pads 187. Movement of the sole-support pads 187 relative to the main body 125 facilitate proper seating of the sole 117 of the golf club head 114 onto the sole-support pads 187 even if the golf club head 114 is not perfectly squared when clamped. Additionally, movement of the sole-support pads 187 accommodates clamping of different golf club heads having a variety of sole sizes and shapes. According to one example, the sole-support pads 187 are made of a metallic material, such as brass. In certain examples, translational movement of the second jaw 130B along the frame 105 is facilitated by a ball screw actuator system that includes a rotatable screw 210 (see, e.g., FIG. 1C). Rotation of the rotatable screw 210, such as via rotation of a gnarled knob rotationally fixed to the rotatable screw 210, engages a ball bearing coupling of a carriage of the second jaw 130B, which linearly translates the carriage, relative to the main body 125, in one of the directions 215 depending on the rotational direction of the rotatable screw 210. Adjustment of the position of the second jaw 130B in this manner helps to accommodate different golf club heads having differently sized sole widths.

Figure 1D:
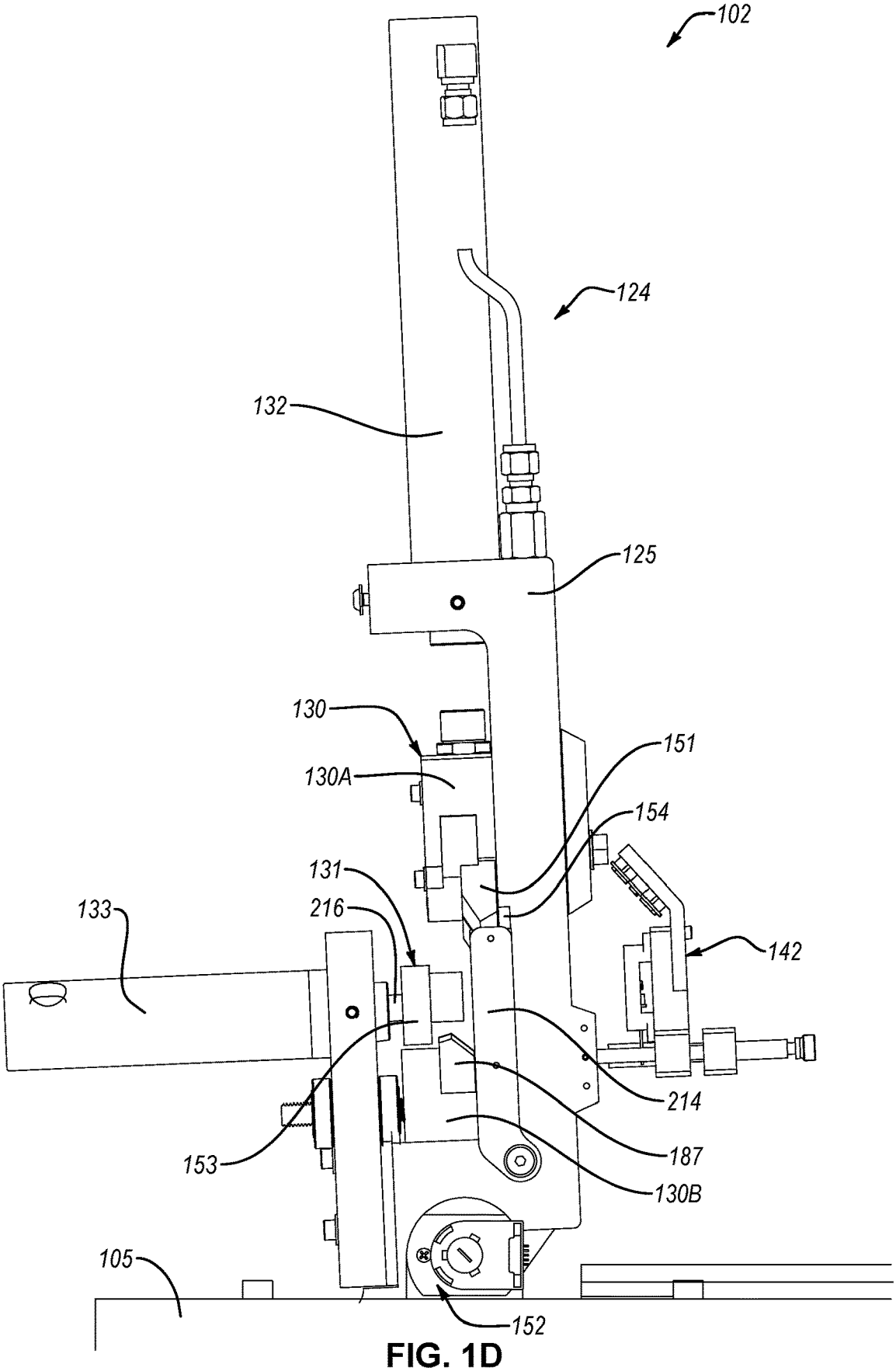
FIG. 1D is a side elevation view of the clamping assembly of the golf club head bending system of FIG. 1A, according to one or more examples of the present disclosure.
Figure 1E:
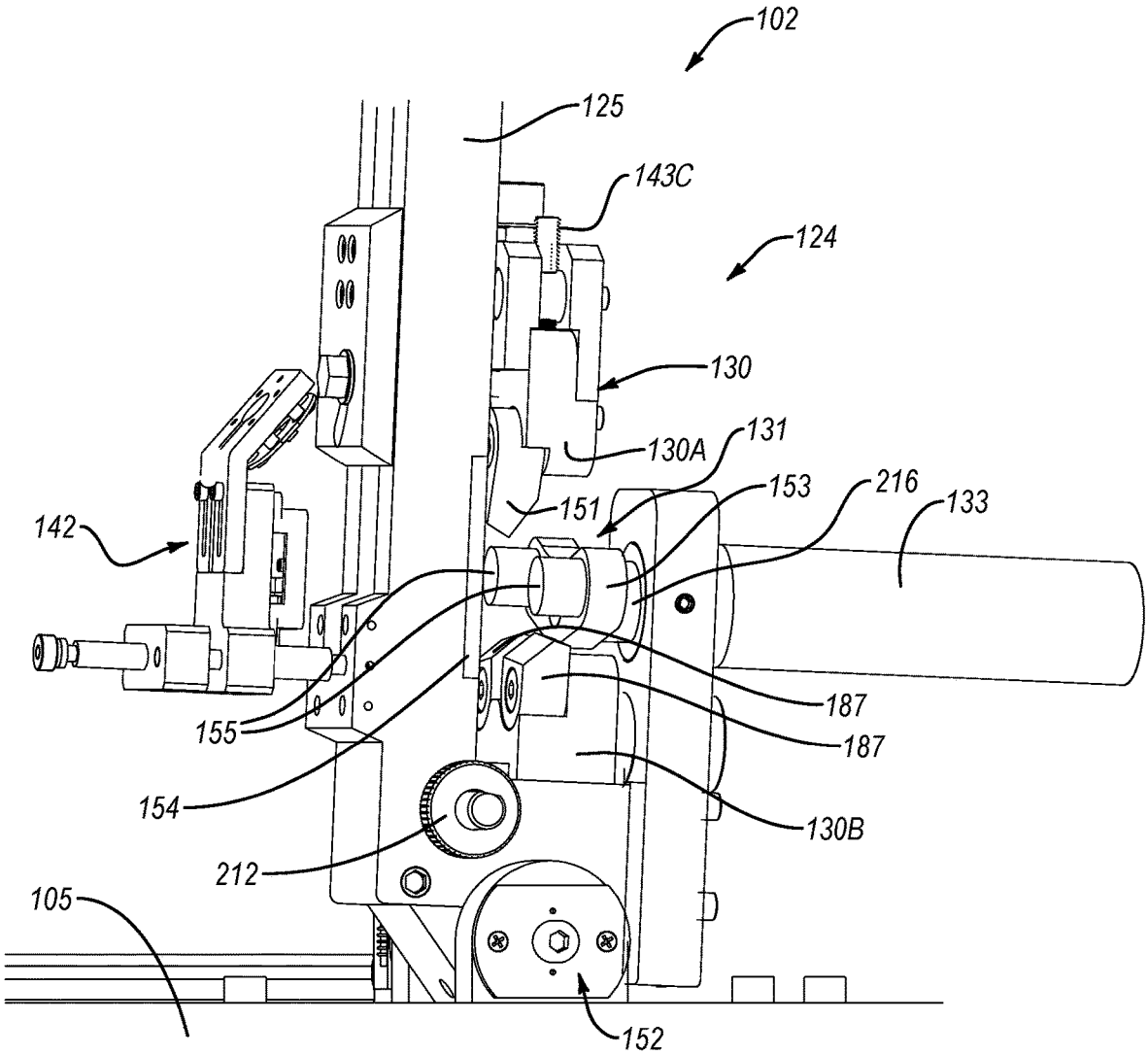
FIG. 1E is a perspective view of the clamping assembly of the golf club head bending system of FIG. 1A, according to one or more examples of the present disclosure.
Figures 1, 1F:
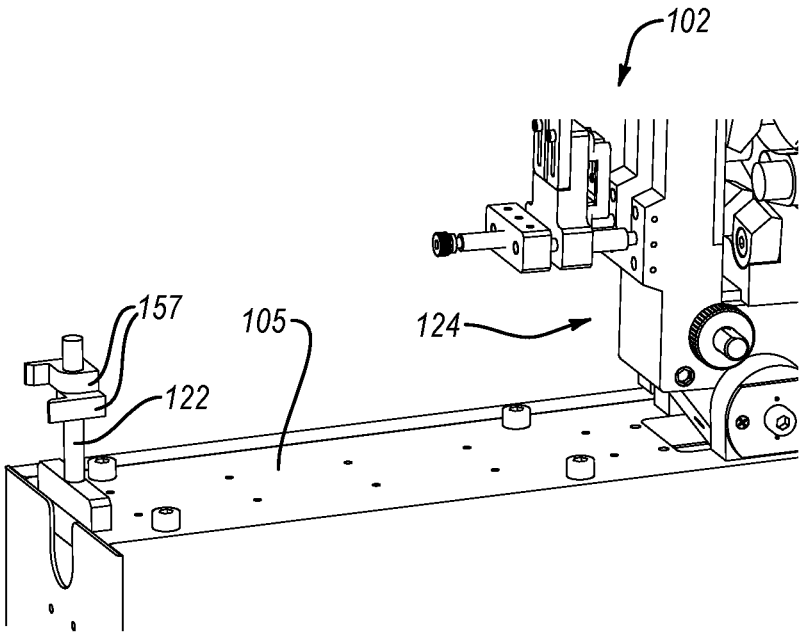
FIG. 1F-1 is a perspective view of a sensor-module calibration pin and the clamping assembly of the golf club head bending system of FIG. 1A, according to one or more examples of the present disclosure.
Figures 1, 1F, 2:
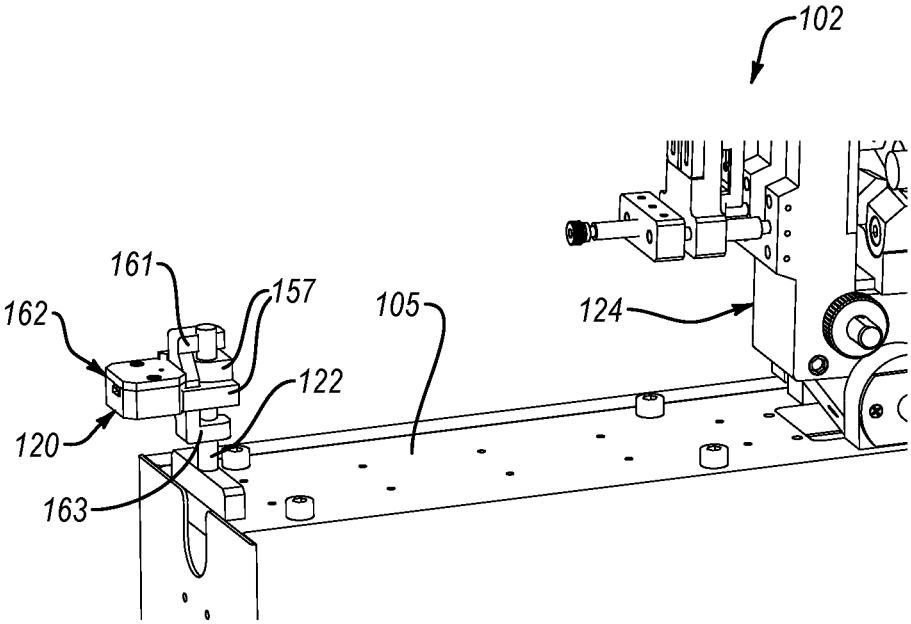
Figure 1G:
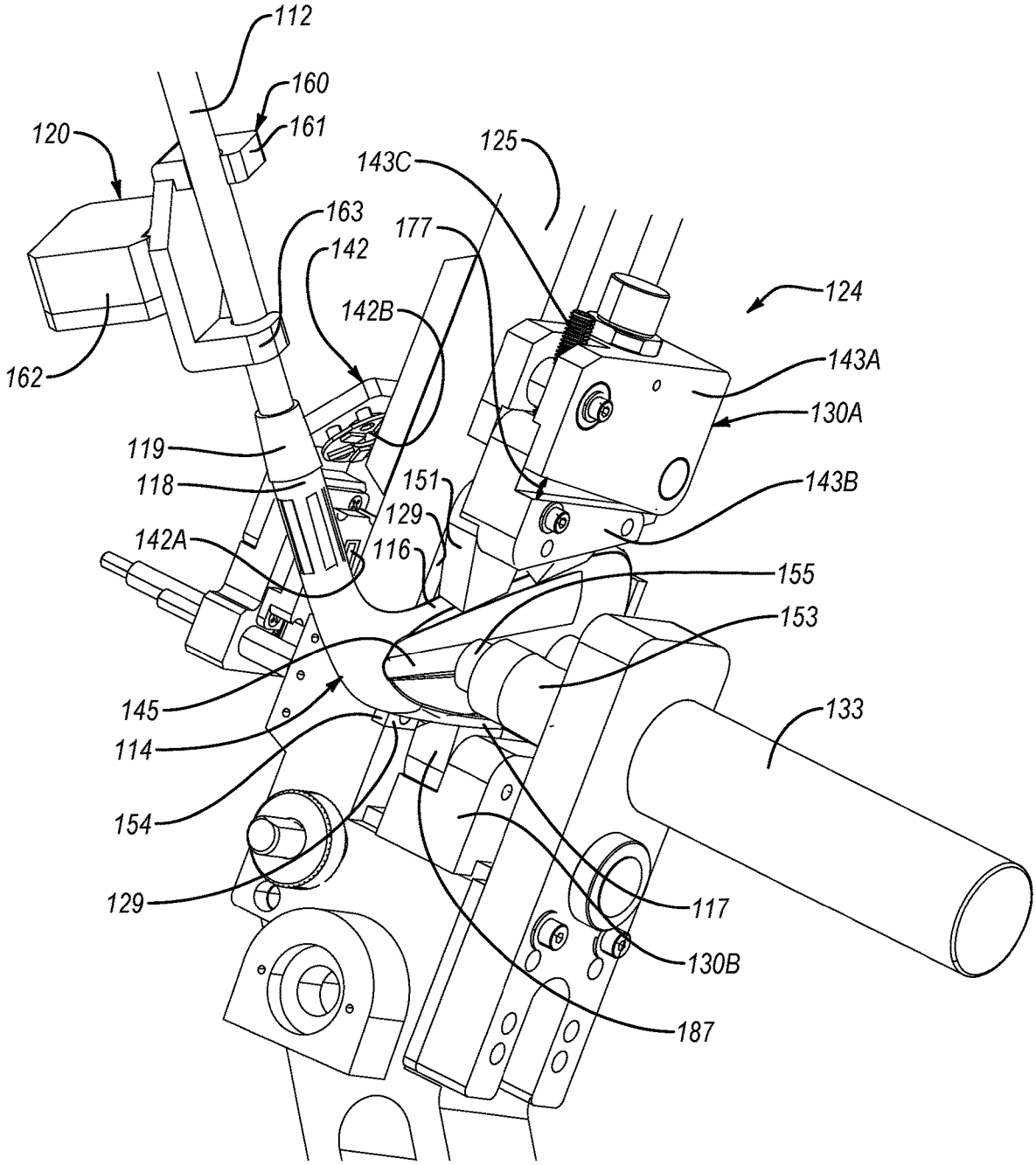
FIG. 1G is a perspective view of the clamping assembly of the golf club head bending system of FIG. 1A, shown with a golf club head clamped by the clamping assembly, according to one or more examples of the present disclosure.
Figure 1H:
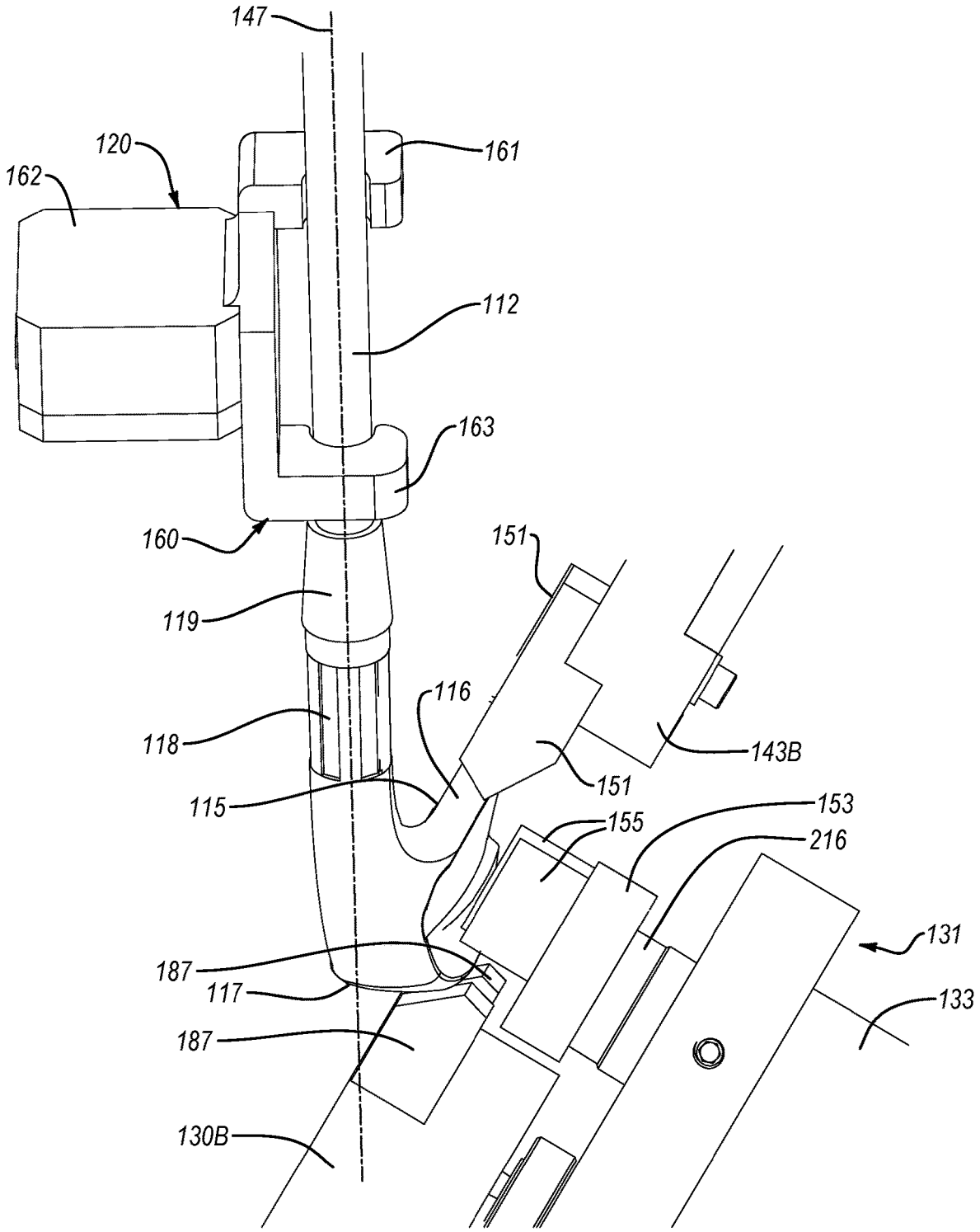
FIG. 1H is a perspective view of the clamping assembly of the golf club head bending system of FIG. 1A, shown with a golf club head clamped by the clamping assembly and omitting some features of the clamping assembly to better show other features of the clamping assembly, according to one or more examples of the present disclosure.
Figure 1I:
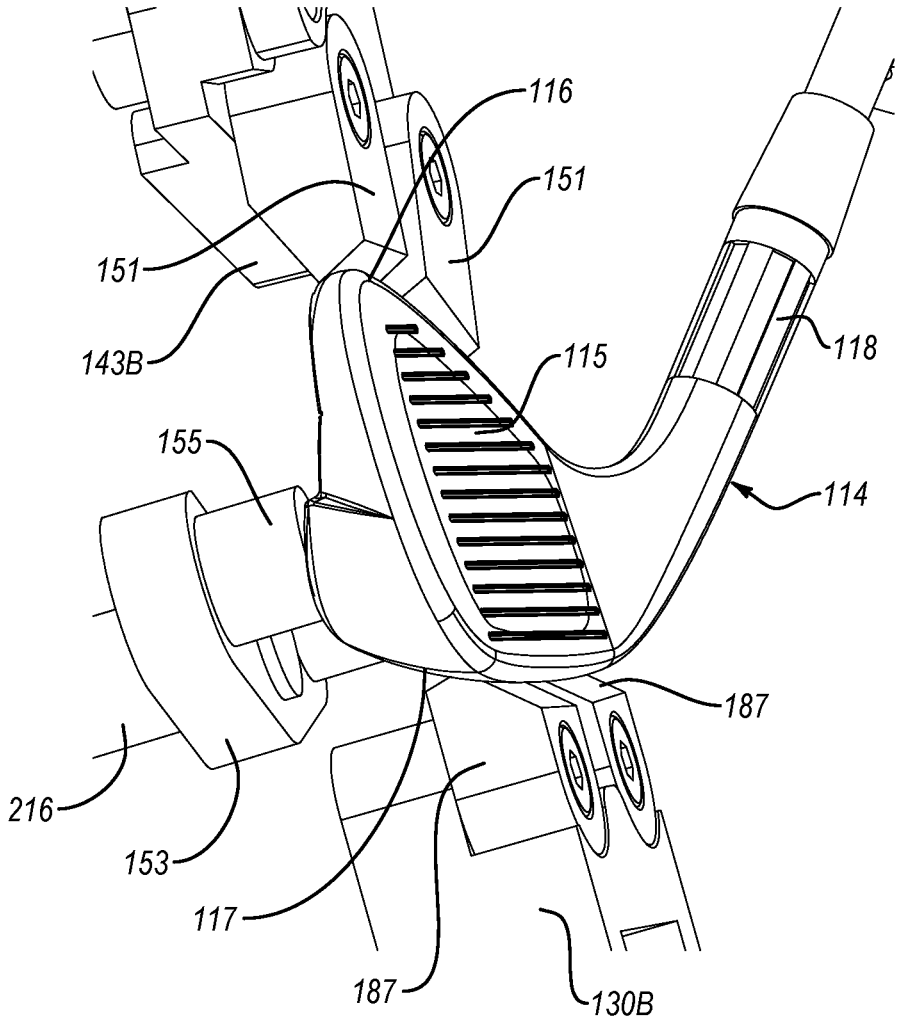
FIG. 1I is a perspective view of the clamping assembly of the golf club head bending system of FIG. 1A, shown with a golf club head clamped by the clamping assembly and omitting some features of the clamping assembly to better show other features of the clamping assembly, according to one or more examples of the present disclosure.
Figure 1J:
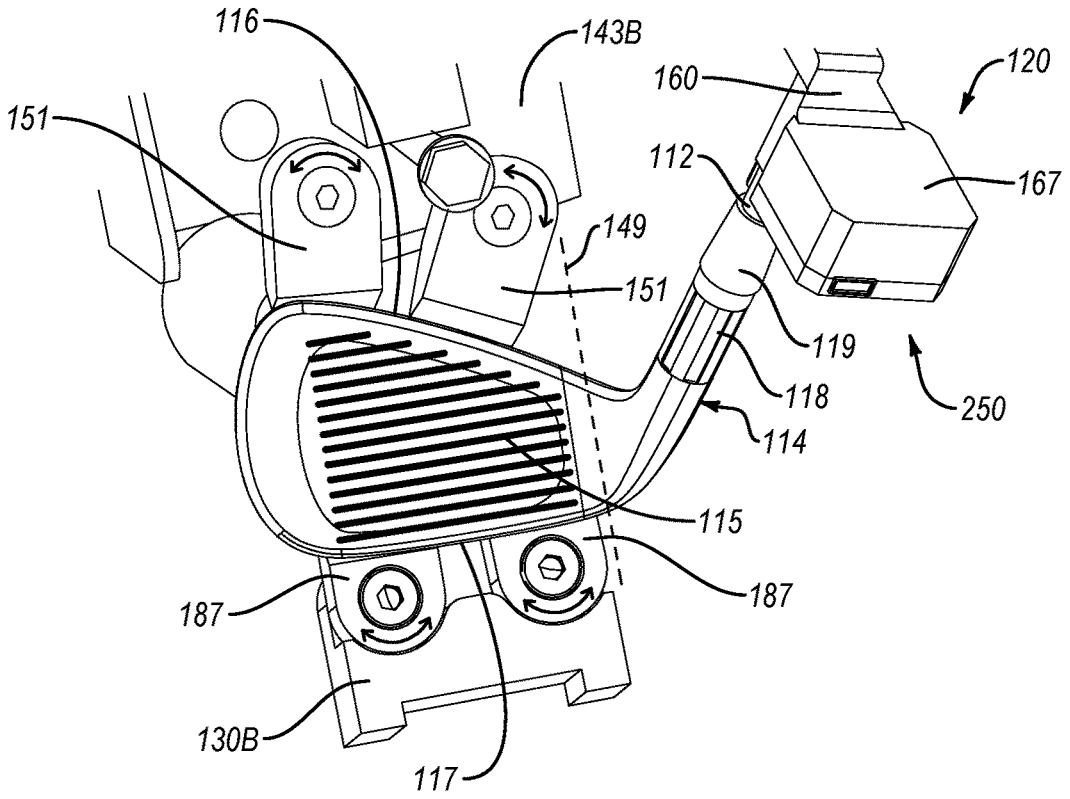
FIG. 1J is a perspective view of the clamping assembly of the golf club head bending system of FIG. 1A, shown with a golf club head clamped by the clamping assembly and omitting some features of the clamping assembly to better show other features of the clamping assembly, according to one or more examples of the present disclosure.
Figure 1K:
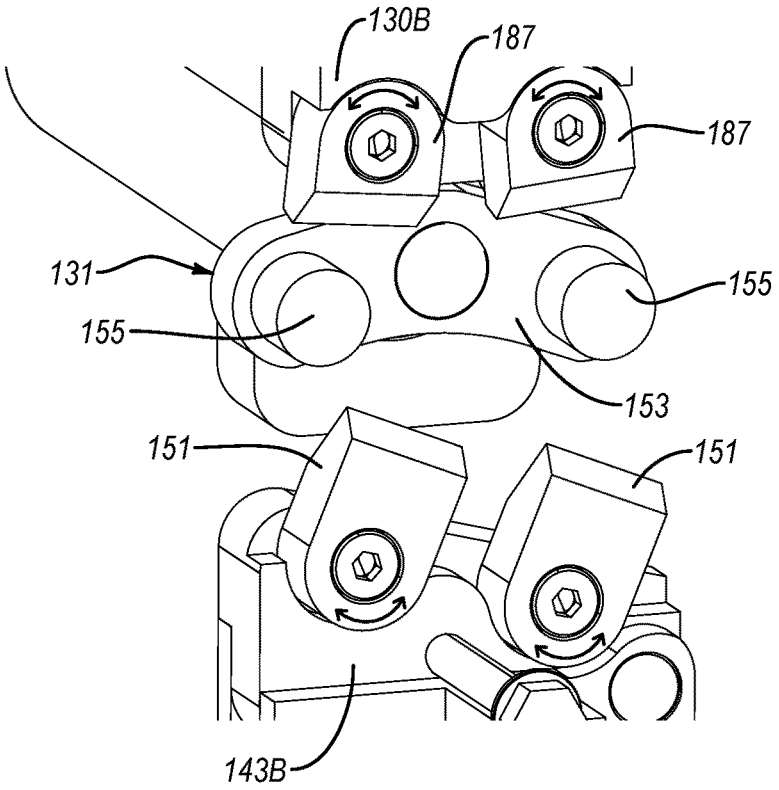
FIG. 1K is a perspective view of the clamping assembly of the golf club head bending system of FIG. 1A, omitting some features of the clamping assembly to better show other features of the clamping assembly, according to one or more examples of the present disclosure.
Figure 2:
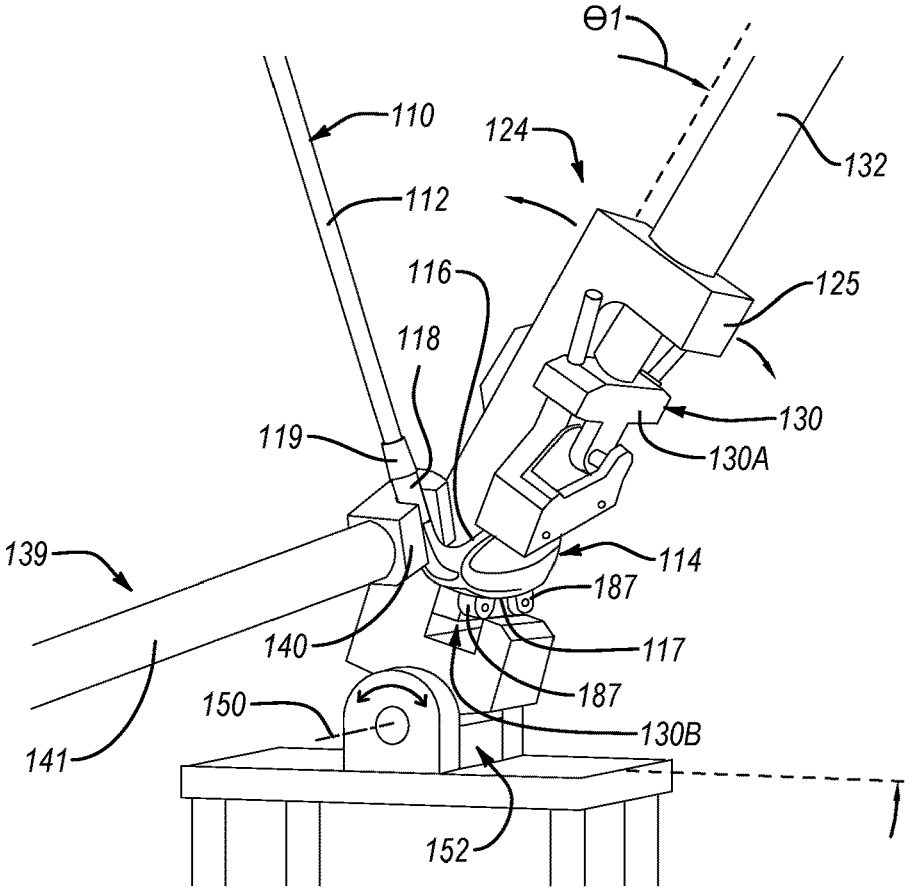

As shown in FIGS. 1C-1E, in some examples, the clamp assembly 124 includes a toe-stop assembly that includes a toe stop 214 and an adjustment mechanism 212. The toe stop 214 is designed to engage a toe of the golf club head 114 when positioned on the second jaw 130B. Engagement between the toe stop 214 and the toe ensures the golf club head 114 is properly positioned, in a heel-to-toe direction, on the second jaw 130B. In other words, the toe stop 214 prevents the golf club head 114 from being over inserted in the heel-to-toe direction, and a lack of engagement with the toe stop 214 is an indication that the golf club head 114 has not been inserted enough in the heel-to-toe direction. Because different golf club heads may have different head lengths, the position of the toe stop 214 in the heel-to-toe direction can be adjusted by manipulation of the adjustment mechanism 212. In the depicted example, the adjustment mechanism 212 includes a knob and a threaded shaft, which are co-rotatably fixed together. The threaded shaft is coupled to the knob at one end and the opposite end of the threaded shaft is coupled to the toe stop 214. The threaded shaft is engaged with internal threads formed in or coupled to the main body 125. As the threaded shaft is rotated via rotation of the knob, engagement between the threads of the threaded shaft and the threads of the main body 125 cause the threaded shaft to translate in the heel-to-toe direction or a toe-to-heel direction depending on the rotational direction the knob is rotated. Translation of the threaded shaft in this manner results in translation of the toe stop 214 relative to the second jaw 130B and a corresponding adjustment to the space defined by the second jaw 130B for receiving the golf club head 114.

Referring to FIGS. 1A-1I and 1K, the secondary clamp 131 includes a jaw that engages a rearward portion 145 of the golf club head 114 when the golf club head 114 is fixed to the pre-clamp magnet 154. The jaw of the secondary clamp 131 includes an end plate 153 and elastomeric pads 155 or pliable pads (e.g., cylindrical pads). The elastomeric pads 155 help the jaw to conform to the shape of the rearward portion 145 of the golf club head 114. The jaw of the secondary clamp 131 is actuated to clamp the golf club head 114 between the jaw and the pre-clamp magnet 154. The secondary clamp 131 is actuated via a hydraulic actuator 133. In some examples, the secondary clamp 131 includes an elastomeric or pliable coupling 216 or hinge between the end plate 153 and the hydraulic actuator 133. The elastomeric coupling provides additional conformity to the shape of the rearward portion 145 of the golf club head 114. Accordingly, the primary clamp 130 clamps the golf club head 114 along a plane parallel to the flat interface surface of the of the pre-clamp magnet 154, and the secondary clamp 131 clamps the golf club head 114 along a plane perpendicular to the flat interface surface of the pre-clamp magnet 154. In examples where the primary clamp 130 and the secondary clamp 131 are actuated by a hydraulic actuator, the clamping pressure applied to the golf club head 114 can be variable based on characteristics of the golf club head 114, such as the type of material of the golf club head 114, and the applied pressure can be measured.

As shown by directional arrows in FIG. 2, the main body 125 is selectively pivotable about an axis 150 relative to the sensor-module calibration pin 122, which is fixed to the frame 105. In one example, the axis 150 is parallel to the flat interface surface of the pre-clamp magnet 154 and fixed relative to the frame 105. In some examples, the frame 105 includes a coupling (e.g., a pin and tab combination) that pivotably couples the main body 125 to the frame 105. The frame portion 102 further includes an actuator 152 (e.g., electric motor) that is selectively operable to pivot the main body 125 about the axis 150 to adjust an angle θ1 defined between the flat interface surface of the pre-clamp magnet 154 and a reference plane fixed relative to the frame 105 and the sensor-module calibration pin 122. In practice, according to some examples, the reference plane is a horizontal plane when the frame 105 is supported on a horizontal surface. Because the strike face of the golf club head 114 is effectively co-planar with the flat interface surface when the strike face is attached to the flat interface surface, the strike face of the golf club head 114 is at the angle θ1 when the flat interface surface is at the angle θ1. Additionally, because the pre-clamp magnet 154, the primary clamp 130, and the secondary clamp 131 are coupled to the main body 125, the pre-clamp magnet 154, the primary clamp 130, and the secondary clamp 131 are co-pivotable with the main body 125 as the main body 125 pivots.

Referring to FIG. 2, when the golf club head 114 is clamped by the clamping assembly 124, in one example, a bending tool 139 of the bending system 100 is used to manually bend a hosel 118 of the golf club head 114 relative to a strike face 115 of the golf club head. The bending tool 139 includes a bar 141 and a bit 140 at the end of the bar 141. The bit 140 is selectively attachable to the hosel 118 of the golf club head 114. When the bit 140 is attached to the hosel 118, an operator can pivot the bar 141, relative to the strike face 115, which bends the hosel 118 relative to the strike face 115 in a direction corresponding with the direction of the force applied to the bar 141 by the operator. For example, pivoting the bar 141 upwards or downwards, along a lie plane 147 parallel to a heel-to-toe direction defined by the golf club head 114 (see, e.g., FIG. 1H), bends the hosel 118 about an axis that is perpendicular to the lie plane 147, thus changing (e.g., increasing or decreasing, respectively) the lie of the golf club head 114. In contrast, pivoting the bar 141 upwards or downwards, along a loft plane 149 parallel to a front-to-rear direction defined by the golf club head 114 (see, e.g., FIG. 1H), bends the hosel 118 about an axis that is perpendicular to the loft plane 149, thus changing (e.g., decreasing or increasing, respectively) the loft of the golf club head 114.

According to some examples, the hosel 118 is bent automatically. For example, the bending system 100 can include bending actuators (e.g., hydraulic or pneumatic actuators) that are mechanically coupled to the hosel 118 (such as via a bit similar to the bit 140) and selectively operable by the electronic controller 111 to move the bit and bend the hosel 118. When the golf club head 114 is clamped by the clamping assembly 124 and the hosel 118 of the golf club head 114 is secured to the bending actuators, activation of one or more of the bending actuators bends the hosel 118 relative to the strike face 115 of the golf club head 114. According to one example, shown in FIG. 3, the bending system 100 includes a lie adjustment actuator 181 and a loft adjustment actuator 183. Actuation of the lie adjustment actuator 181 moves the hosel 118 along the lie plane, which bends the hosel about the axis that is perpendicular to the lie plane, thus changing the lie of the golf club head 114. In contrast, actuation of the loft adjustment actuator 183 moves the hosel 118 along the loft plane, which bends the hosel about the axis that is perpendicular to the loft plane, thus changing the loft of the golf club head 114. In a bending application, only one or both of the lie adjustment actuator 181 or the loft adjustment actuator 183 is actuated depending on whether only one or both of the lie or the loft of the golf club head is to be adjusted. When both the lie and the loft are to be adjusted, actuation of the lie adjustment actuator 181 and the loft adjustment actuator 183 can be actuated consecutively or concurrently to adjust the lie and the loft consecutively or concurrently.

Figure 4A:
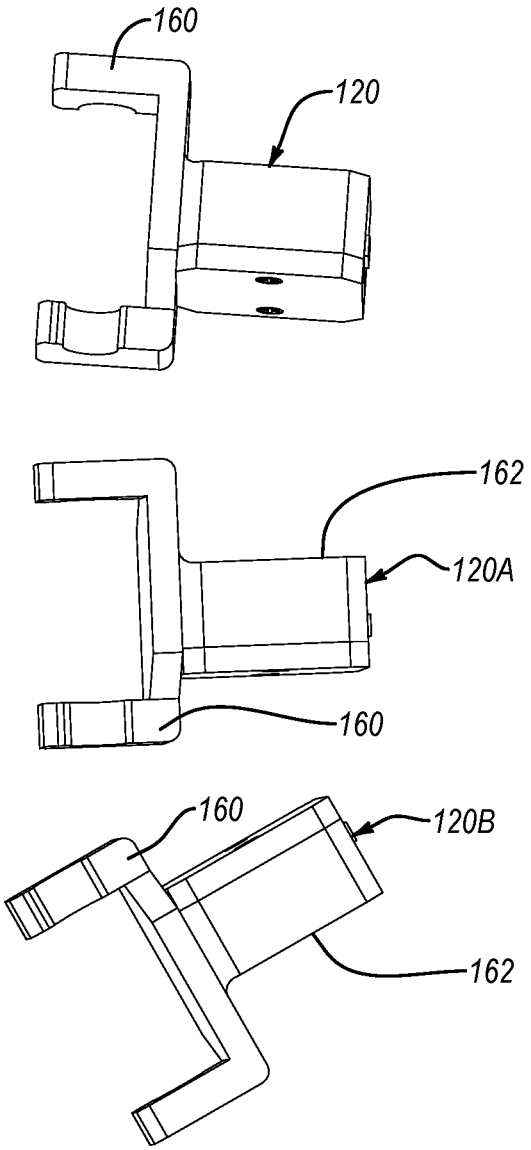
FIG. 4A is a perspective view of a set of sensor modules of a golf club head bending system, according to one or more examples of the present disclosure.
Figure 4B:
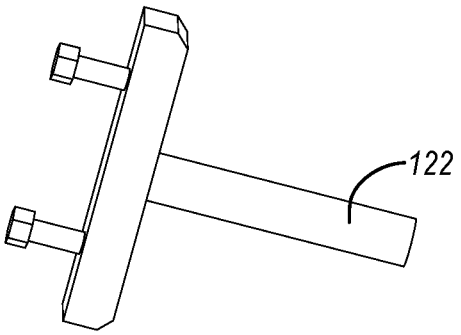
FIG. 4B is a perspective view of a sensor-module calibration pin of a golf club head bending system, according to one or more examples of the present disclosure.
Figure 5A:
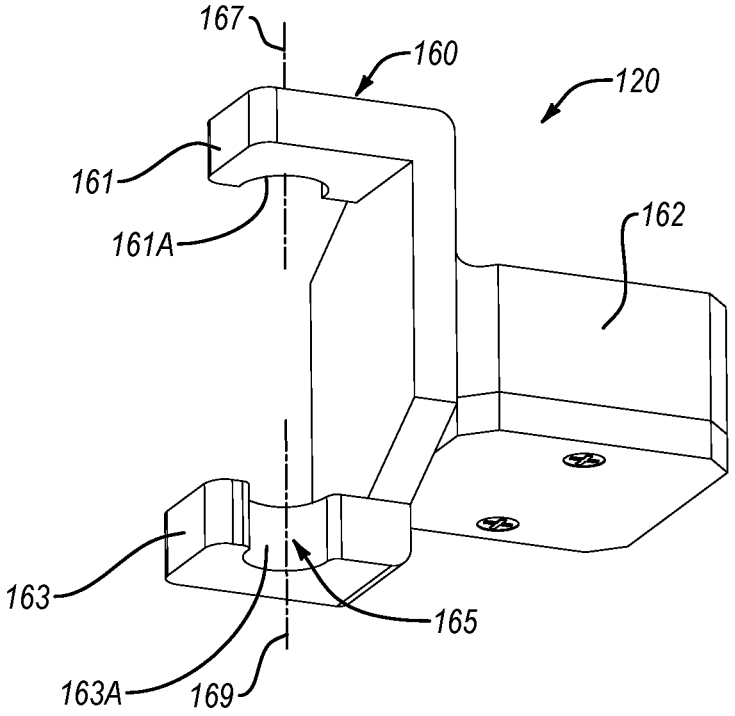
FIG. 5A is a perspective view of a sensor module of a golf club head bending system, according to one or more examples of the present disclosure.
Figure 5B:
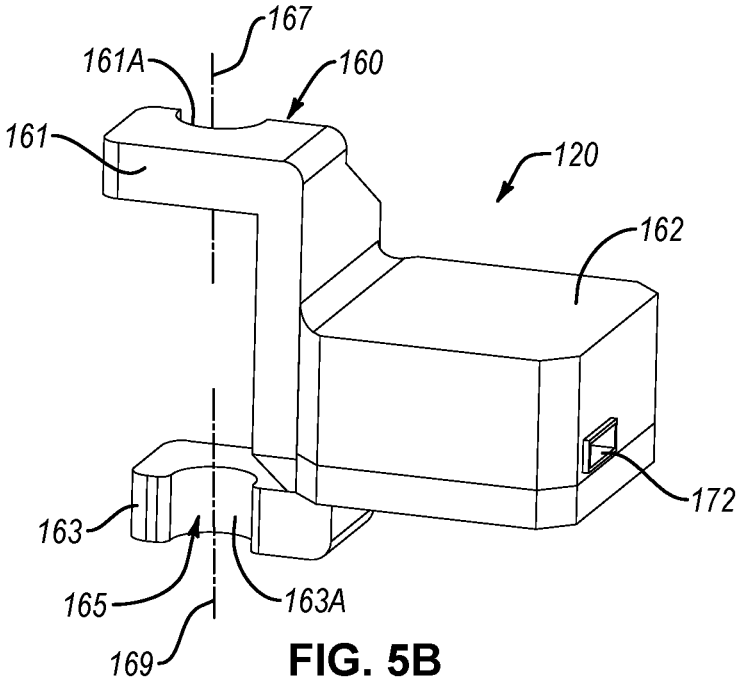
FIG. 5B is a perspective view of the sensor module of FIG. 5A, according to one or more examples of the present disclosure.

Referring to FIGS. 4A and 5A-7, according to certain examples, the position sensing device 250 of the bending system 100 is a sensor module 120 that includes a shaft attachment portion 160 and a sensor portion 162. The shaft attachment portion 160 is configured to be temporarily and separately attached to the sensor-module calibration pin 122 and a shaft 112 of a golf club 110 that includes the golf club head 114. The sensor portion 162 includes a housing fixed to the shaft attachment portion 160 and includes a sensor array 159 housed within the housing. Accordingly, the sensor array 159 (i.e., the sensors of the sensor array) is fixed or does not move relative to the housing of the sensor portion 162, and thus relative to the shaft attachment portion 160. In other words, the sensor array 159 moves when the sensor module 120 is moved. In some examples, the bending system 100 includes multiple sensor modules 120 each with a differently sized shaft attachment portion 160 to accommodate differently sized shafts. For example, as shown in FIG. 4A, the bending system 100 can include a set of sensor modules where the shaft attachment portion 160 (or other portion) of each one of the sensor modules of the set can be different than the shaft attachment portion 160 of any other one of the sensor modules of the set (e.g., the shaft attachment portion 160 of the sensor module 120 is different than that of a sensor module 120A and a sensor module 120B, and the shaft attachment portion 160 of the sensor module 120A is different than that of the sensor module 120B).

Referring to FIGS. 5A-6B, in certain examples, the shaft attachment portion 160 is configured to attach to the shaft 112 of the golf club 110, at a location away from a grip 113 of the golf club 110 and near a hosel 118 of the golf club head 114, with a snap fit. In some examples, the golf club head 114 may not have a shaft attached to the hosel 118, but may have a temporary pin, replicating the shaft, inserted into the hosel when the golf club head 114 is bent. Accordingly, as used herein, a shaft of the golf club head can also mean or be used interchangeably with a temporary pin. In the illustrated example, the shaft attachment portion 160 includes a first retention arm 161 and a second retention arm 163, which is axially spaced apart from the first retention arm 161. Each one of the first retention arm 161 and the second retention arm 163 define a shaft retention channel 161A and a shaft retention channel 163A, respectively, which can be semi-circular shaped channel in some examples. The shaft retention channels 161A, 163A of the first retention arm 161 and the second retention arm 163 collectively define a shaft channel 165 configured to receive and retain the shaft 112 of the golf club 110. The first retention arm 161 and the second retention arm 163 are axially aligned, such that central axes 167, 169 of the shaft retention channels 161A, 163A and a central axis 121 of the shaft 112, when retained by the first retention arm 161 and the second retention arm 163, are collinear.

The first retention arm 161 and the second retention arm 163 are oppositely oriented, such that the shaft retention channel 161A of the first retention arm 161 faces a first direction and the shaft retention channel 163A of the second retention arm 163 faces a second direction, opposite the first direction. In other words, the first retention arm 161 and the second retention arm 163 are on opposite sides of a plane within which the central axes 167, and 169 lie. Moreover, the first retention arm 161 and the second retention arm 163 are resiliently flexible relative to each other.

In operation, the shaft 112 is temporarily affixed or retained by the shaft attachment portion 160 by (1) positioning a portion of the shaft 112 within the semi-circular shaped channel of one of the first retention arm 161 or the second retention arm 163, (2) twisting the shaft attachment portion 160 about an axis angled (e.g., perpendicular) to the central axis 121 of the shaft 112 to move the other one of the first retention arm 161 or the second retention arm 163 away from the shaft 112, (3) while twisting the shaft attachment portion 160, moving the other one of the first retention arm 161 or the second retention arm 163 around the shaft 112, and then (4) untwisting the shaft attachment portion 160 so that the other one of the first retention arm 161 or the second retention arm 163 resiliently snaps onto the shaft 112. The shaft attachment portion 160 is detached from the shaft 112 using similar steps, but in the opposite order. The flexibility, positions, and spacing of the first retention arm 161 and the second retention arm 163, relative to each other, dictates the twisting force necessary to flex the shaft attachment portion 160 onto and off of the shaft 112 and the retention force applied onto the shaft 112 by the shaft attachment portion 160. The retention force is sufficient to maintain the position and orientation of the shaft attachment portion 160 on the shaft 112 while the golf club head 114 is bent.

Figure 6A:
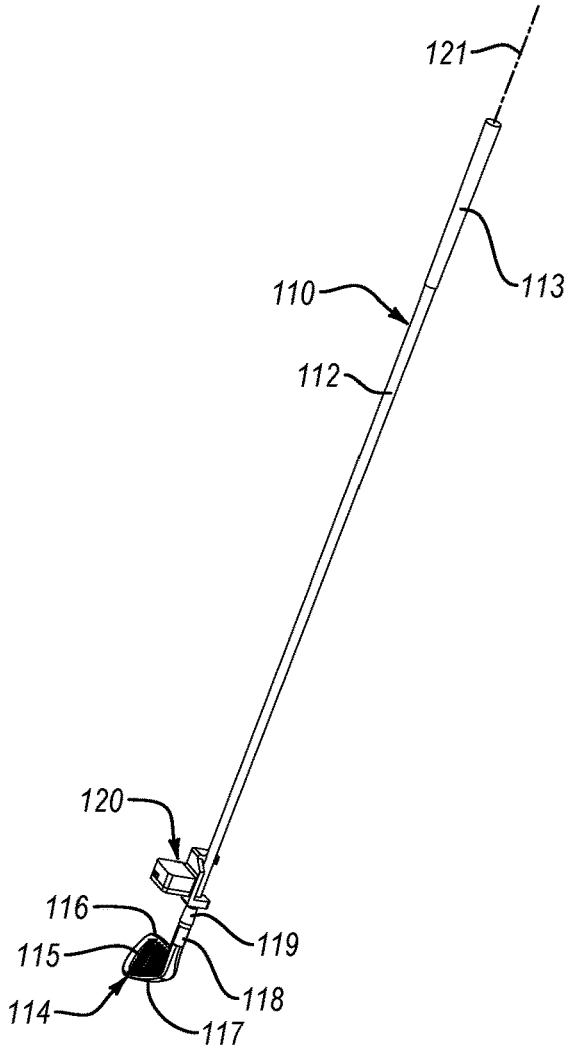
FIG. 6A is a perspective view of the sensor module of FIG. 5A attached to a golf club, according to one or more examples of the present disclosure.
Figure 6B:
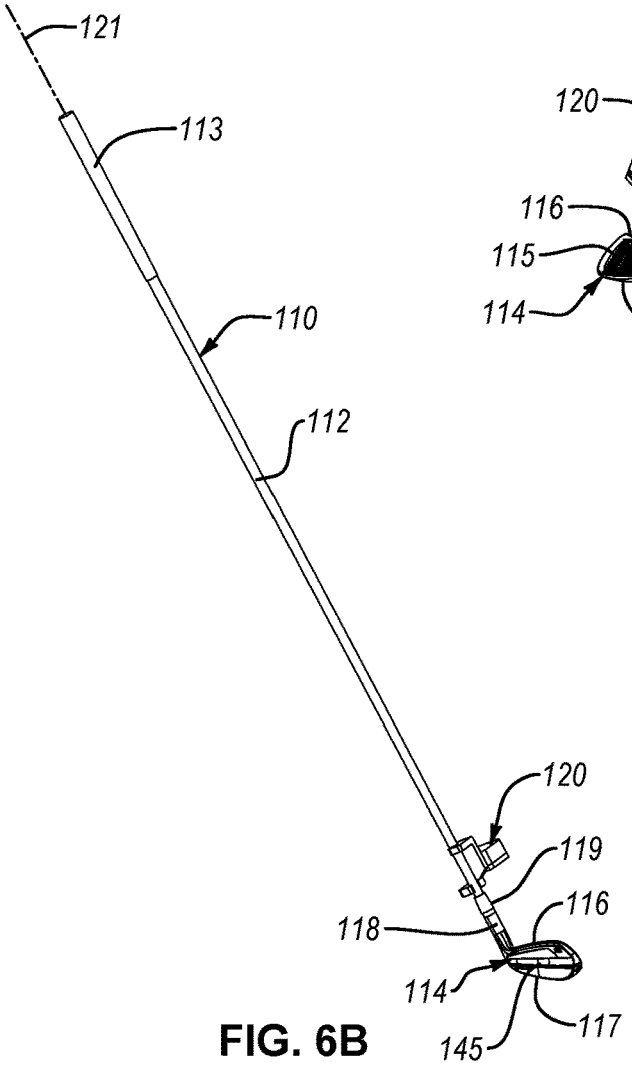
FIG. 6B is an alternative perspective view of the sensor module of FIG. 5A attached to the golf club of FIG. 6A, according to one or more examples of the present disclosure.

As shown in FIGS. 6A and 6B, the shaft attachment portion 160 is attached to the shaft 112 at a location near the hosel 118. In one example, the shaft attachment portion 160 is directly adjacent (e.g., in contact with) the hosel 118. When the golf club 110 has a ferrule 119, the ferrule 119 is considered an extension of the hosel 118 such that the shaft attachment portion 160 is directly adjacent (e.g., in contact with) the ferrule 119. Such a position enables the sensor array 159 of the sensor portion 162 to also be located close to the hosel 118, which promotes accuracy in determining the location of the hosel 118 relative to the strike face of the golf club head 114, and thus the amount the hosel 118 has been bent relative to the strike face. Positioning the sensor module 120 next to or in contact with the hosel 118 helps to reduce the affects of shaft wobble that can be experienced as the hosel 118 is being bent.

Additionally, the detection of the position of the hosel 118 is dependent on the assumption that the shaft 112 is properly aligned with the hosel 118 (e.g., central axes are colinear). Misalignment between the shaft 112 and the hosel 118, such as due to manufacturing inconsistences and tolerances, can create inaccuracies in detecting the position of the hosel 118. Positioning the sensor module 120 next to or in contact with the hosel 118 helps to eliminate or reduce the effect of shaft misalignment (e.g., when the central axis 121 of the shaft 112 is not colinear with a central axis of the hosel 118) because shaft misalignment is more pronounced away from the hosel 118.

Finally, positioning the sensor module 120 next to or in contact with the hosel 118 enables the bending system 100 to adjust the loft and/or the lie of the golf club head 114 before a shaft is attached to the golf club head 114, by attaching the sensor module 120 to a pin in the hosel 118 that replicates the tip portion of the shaft. Accordingly, when used herein, shaft can be interchangeable with a full shaft of a golf club of a pin designed to replicate a full shaft of a golf club.

According to some examples, in addition to the sensor module 120 near the hosel 118, to improve the accuracy of the sensed position of the hosel 118, one or more additional sensor modules 120 can be positioned at locations on the shaft away from the hosel 118. The sensor readings from the multiple sensor modules 120 can be received by the electronic controller 111 of the bending system 100, which determines the position of the hosel 118 based on an averaging or comparison of the sensor readings from the sensor modules 120.

Figure 7:
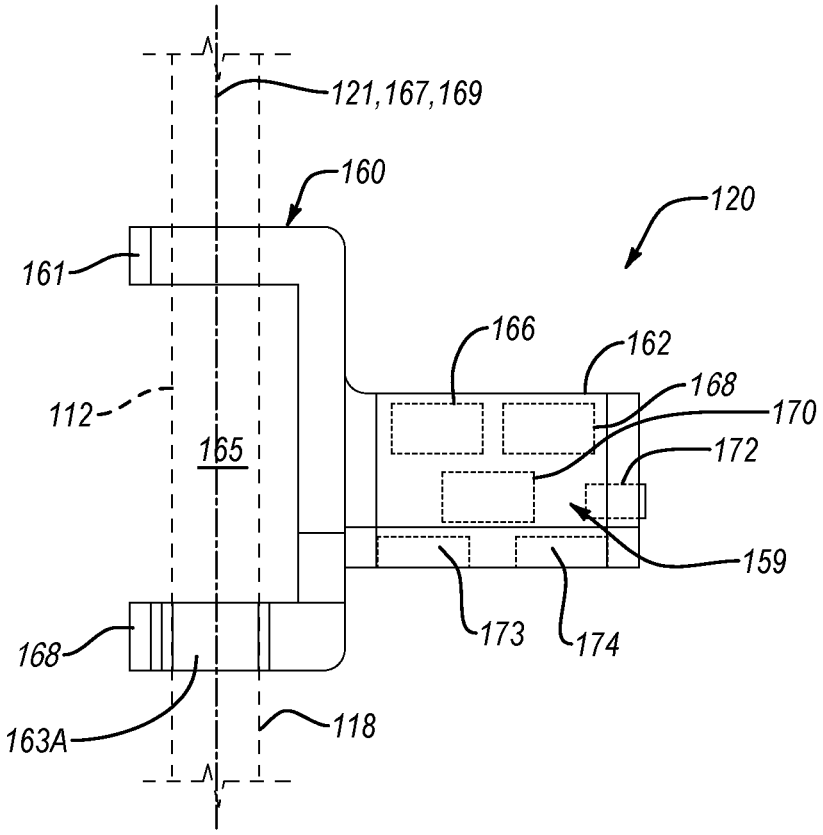
FIG. 7 is a side elevation view of the sensor module of FIG. 5A, according to one or more examples of the present disclosure.

Referring to FIG. 7, in some examples, the sensor array 159 of the sensor portion 162 includes at least one sensor (e.g., at least one of an accelerometer 166, a gyroscope 168, or a magnetometer 170) that is configured to help determine the position and orientation of the sensor portion 162 relative to a home position (or other known position). The sensor data from the sensor array 159 is translated or converted to degrees within an x-axis plane and a y-axis plane. In certain examples, the sensor array 159 includes at least two sensors (e.g., at least two of the accelerometer 166, the gyroscope 168, or the magnetometer 170). According to the illustrated example, the sensor array 159 includes at least three sensors (e.g., the accelerometer 166, the gyroscope 168, and the magnetometer 170). The accelerometer 166 is configured to detect the rate of change of the position of the sensor portion 162 (e.g., the magnitude of a position vector), and the gyroscope 168 is configured to detect the position of the sensor portion 162 (e.g., the position of the position vector in space) along three axes of orientation (e.g., along an x-axis, a y-axis, and a z-axis). Accordingly, the accelerometer 166 and the gyroscope 168 help to detect a position of the sensor module 120, as well as a heading or direction of motion of the sensor module 120 relative to the three axe of orientation. The magnetometer 170 is configured to detect changes in gravity, and the electronic controller 111 adjusts the data detected by the accelerometer 166 and the gyroscope 168 in view of changes to gravity detected by the magnetometer 170. The sensors of the sensor array 159 are fixed relative to each other such that the sensors do not translationally move or are translationally stationary relative to each other. According to some examples, the sensor array 159 is capable of detecting the orientation of the hosel 118, and thus the lie and the loft of the golf club head 114, within +/−0.33°, in certain implementations, and +/−0.2°, in other implementations.

The sensors of the sensor array 159 are electrically powered. In one example, the electrical power is supplied to the sensor array 159 via a wired connection with a power source remote from the sensor portion 162. However, as shown, in certain examples, the electrical power is supplied to the sensor array 159 via a power source 173 (e.g., a battery) onboard the sensor portion 162. In some examples, the sensor portion 162 includes a rechargeable battery and an interface 172 or port (e.g., a USB or USB-C port) configured to receive electrical power for recharging the battery.

The bending system 100 further includes an electronic controller 111, which can be part of or communicatively coupled with the graphical user interface 106. The electronic controller 111 receives sensor input from the sensor portion 162 and determines the location of the hosel 118 relative to the strike face of the golf club head 114, and thus the amount the hosel 118 has been bent relative to the strike face, based on the sensor input. In one example, the electronic controller 111 receives the sensor input via a wired connection with the sensor portion 162. However, as shown, in certain examples, the electronic controller 111 receives the sensor input via a wireless connection. For example, as shown in FIG. 7, the sensor portion 162 can include a wireless transceiver 174, which is capable of sending wireless communication signals, identifying the sensor input, to the electronic controller 111. The wireless transceiver 174 helps to move the sensor module 120 around without entanglement issues commonly associated with wires of a wired connection.

A method of bending a golf club head 114, using the bending system 100, includes a first calibration step and a second calibration step. The first calibration step includes calibrating the frame portion 102 to set a known position (e.g., home position) of the frame portion 102 in space. The first calibration step is performed once when the bending system 100 is turned on from an off mode. The second calibration step includes calibrating the sensor module 120 to set a known position (e.g., home position) of the sensor module 120 relative to the frame 105. The second calibration step is performed before each golf club head is bent. According to one example, as shown in FIGS. 1A, 1F-1, and 1F-2, calibrating the sensor module 120 includes attaching the sensor module 120 to the calibration pin 122 and, when attached to the calibration pin 122, setting the position of the sensor module 120 as the home position. The calibration pin 122 includes a clocking feature 157 (e.g., a notch, stops, etc.) that ensures the sensor module 120 attaches to the calibration pin 122 in only a single position and single orientation (e.g., direction), which are associated with the home position. In certain examples, when attached to the calibration pin 122 and properly clocked relative to the calibration pin 122, the electronic controller 111 sets the position and orientation of the sensor module (as sensed by the sensor array 159) to the home position, which can be associated with an origin of a 3-axis coordinate system (e.g., x-axis coordinate of 0, y-axis coordinate of 0, and z-axis coordinate of 0).

Figure 8:
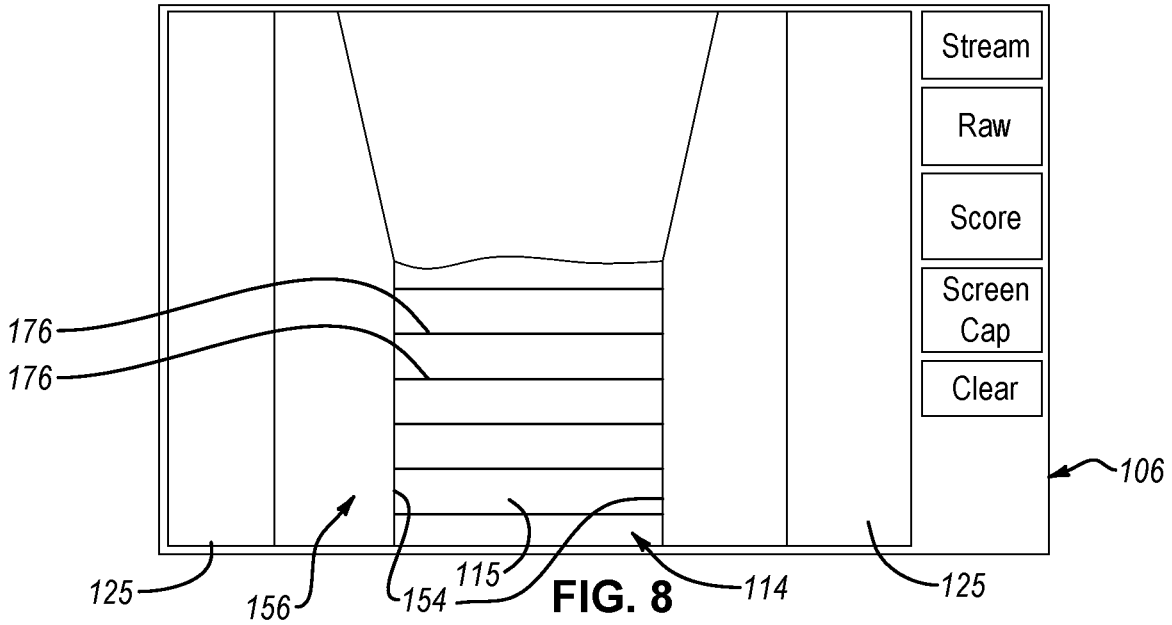
FIG. 8 is a schematic representation of a graphical user interface displaying an image captured by a camera assembly of a golf club head bending system, according to one or more examples of the present disclosure.

Before or after the first calibration step and the second calibration step, the golf club head 114 of the golf club 110 is clamped by the clamping assembly 124. Clamping the golf club head 114, using the clamping assembly 124, includes positioning the golf club head 114 on the sole-support pads 187 of the second jaw 130B, and magnetically attaching the strike face of the golf club head 114 to the pre-clamp magnet 154. Using an image captured by the camera assembly 142 and displayed by the graphical user interface 106, the orientation of the golf club head 114 can be manually adjusted or squared while magnetically attached to the pre-clamp magnet 154. Referring to FIG. 8, which is an image captured by the camera assembly 142 when the strike face 115 is secured to the pre-clamp magnet 154. The aperture 156 enables the strike face 115 and the scorelines 176 formed in the strike face 115 to be visible in the image. The operator can adjust the orientation of the golf club head 114 based on the orientation of the scorelines 176 viewed in the image.

Figure 9:
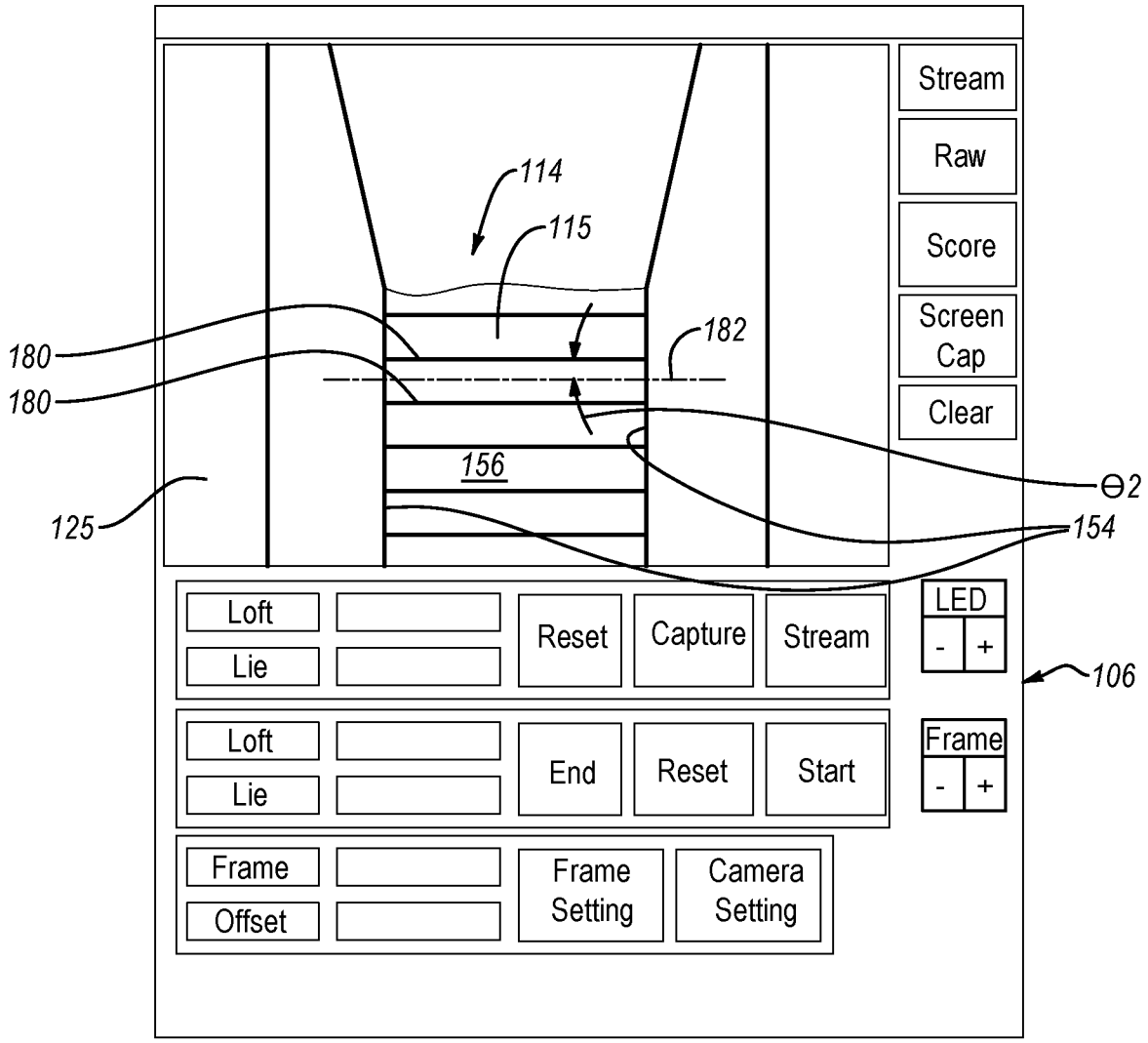
FIG. 9 is a schematic representation of the graphical user interface of FIG. 8 showing scoreline indicia superimposed over the image captured by the camera assembly, according to one or more examples of the present disclosure.

As shown in FIG. 9, to help aid the operator in making adjustments, the electronic controller 111 can be configured to detect the scorelines 176 and superimpose indicia 180 (e.g., graphical lines), representing scorelines, over the scorelines 176. The electronic controller 111 then determines an angle θ2 of the indicia 180 relative to a reference line 182, which corresponds with squared scorelines. The angle θ2 determined by the electronic controller 111 can be displayed by the graphical user interface 106 and the operator can adjust the orientation of the golf club head 114 until the angle θ2 is zero, or close to zero, which indicates that the scorelines 176 are squared or close to being squared. In some examples, the camera assembly 142 includes a light 142B (e.g., light-emitting diode (LED) light that helps to illuminate the surface of the strike face 115 for better viewing. According to certain examples, the intensity of the light can be adjusted based on the surface finish of the strike face 115 to improve the visibility of the scorelines 176.

After the golf club head 114 is supported on the second jaw 130B and the strike face 115 is attached to the pre-clamp magnet 154 (and after an operator squares the scorelines 176 if needed or desired), the golf club head 114 is further clamped by actuating the first jaw 130A to clamp the golf club head 114 between the first jaw 130A and the second jaw 130B. The clamping step of the method additionally includes actuating the secondary clamp 131 to clamp the golf club head 114 between the jaw of the secondary clamp 131 and the pre-clamp magnet 154.

Before or after the golf club head 114 is clamped by the clamping assembly 124 of the bending system 100, in some examples, the angle θ1 of the flat interface surface of the pre-clamp magnet 154 is adjusted, via actuation of the actuator 152, into a specified loft angle associated with the golf club head 114. The specified loft angle can be equal to the standard loft of the golf club head 114. For example, the standard loft of the golf club head 114 can be entered into or received by the electronic controller 111 of the bending system 100, and the angle θ1 can be adjusted so that the angle θ1 is equal to the standard loft of the golf club head 114. Alternatively, the specified loft angle can be any of various known angles, such as zero. In certain examples, the clamping assembly 124 helps determine an initial loft and/or initial lie of the golf club head 114 based on a known position of the actuator 152 relative to the frame 105. The position of the actuator 152, relative to the frame 105, is known based on one or more of actuation commands sent to the actuator 152 or feedback from the actuator 152. However, in other examples, the position of the clamping assembly 124, and thus the initial loft and/or initial lie of the golf club head 114, is determined by a clamping-assembly sensor module 120C (see, e.g., FIGS. 16 and 19) as will be described in more detail below.

The position of the clamping assembly 124, and thus the position of the flat interface surface 129, can be positioned into a desired bending position before bending of the golf club head 114 takes place. The desired bending position can be any of various positions. However, in certain examples, the desired bending position is the position of the clamping assembly 124 when the hosel 118 of the golf club head 114 (when properly clamped by the clamping assembly 124) lies within a plane perpendicular relative to the frame 105. With the hosel 118 being perpendicular to the frame 105, the bending tool 139 can be in the same orientation (e.g., parallel to the frame 105) when the bit 140 is attached to the hosel 118, regardless of the loft of the golf club head 114. This helps to present the bending tool 139 to an operator, tasked to manually bend the golf club head 114, in a consistent manner (i.e., the same orientation) regardless of the type or loft of the golf club head 114. To achieve perpendicularity of the hosel 118 for differently lofted golf club heads, the position of the clamping assembly 124, relative to the frame 105, must be adjusted based on the known loft of the golf club heads. For example, the clamping assembly 124 is more upright, relative to the frame 105, when bending golf club heads having less loft compared to those having more loft.

The method of bending the golf club head 114 further includes attaching the bending tool 139 to the hosel 118 of the golf club head 114. But before the golf club head 114 is bent by the bending tool 139 (or even before the bending tool 139 is attached to the hosel 118), the sensor module 120 is moved from its home position on the sensor-module calibration pin 122 and attached to the shaft 112 of the golf club 110 near the hosel 118. As the sensor module 120 is moved, the sensor array 159 detects the motion of the sensor module 120 away from the home position and tracks the position the sensor array 159 relative to the 3-axis coordinate system and the orientation (e.g., angle) of the sensor array 159 relative to the orientation when in the home position. Accordingly, at any given position of the sensor module 120 away from the home position, the coordinates of the sensor module 120 on the 3-axis coordinate system and the orientation (e.g., angle) of the sensor module 120 are known. Thus, when the sensor module 120 is attached to the shaft 112, the sensor input received by the electronic controller 111 from the sensor module 120 can be used by the electronic controller 111 to determine an initial (e.g., pre-bent) position of the golf club head 114, an initial loft of the golf club head 114, and an initial lie of the golf club head 114. According to one example, all three of the accelerometer 166, the gyroscope 168, and the magnetometer 170 are used to determine the initial position of the sensor module 120, and thus the initial position of the golf club head 114. In certain examples, the magnetometer 170 is deactivated, and only one or both of the accelerometer 166 and the gyroscope 168 are used to track the position of the hosel 118 as the hosel 118 is bent.

In some examples, the initial loft and/or the initial lie of the golf club head 114, as detected by the sensor module 120, are compared against the loft and/or the lie of the golf club head 114, as determined by the position of the actuator 152 of the clamping assembly 124 or by the clamping-assembly sensor module 120C, to ensure the sensor module 120 is properly attached to the shaft 112. The initial loft and/or the initial lie of the golf club head 114, as detected by the sensor module 120, should be the same as the loft and/or the lie of the golf club head 114, as determined by the actuator 152 or by the clamping assembly sensor module 120C. When the loft and/or the lie detected by the sensor module 120 and determined by the actuator 152 or by the clamping assembly sensor module 120C are the same, proper attachment to the shaft 112 can be confirmed. However, when the loft and/or the lie detected by the sensor module 120 and determined by the actuator 152 or by the clamping-assembly sensor module 120C are different, the sensor module 120 is not attached properly. Adjustment of the sensor module 120 on the shaft 112 can be made until the loft and/or the lie detected by the sensor module 120 and determined by the actuator 152 or by the clamping-assembly sensor module 120C are the same. It is recognized that in some examples, when the lie of the golf club head 114 is not manually squared, the camera assembly 142 can help determine the discrepancy between the actual lie and the squared lie, calculate an offset, and adjust the determination of the lie of the golf club head 114 after bending the hosel 118 by the offset. In this manner, a non-squared strike face can be compensated for automatically, via the camera assembly 142, without manual adjustment of the golf club head 114 in the clamping assembly 124.

Figure 10:
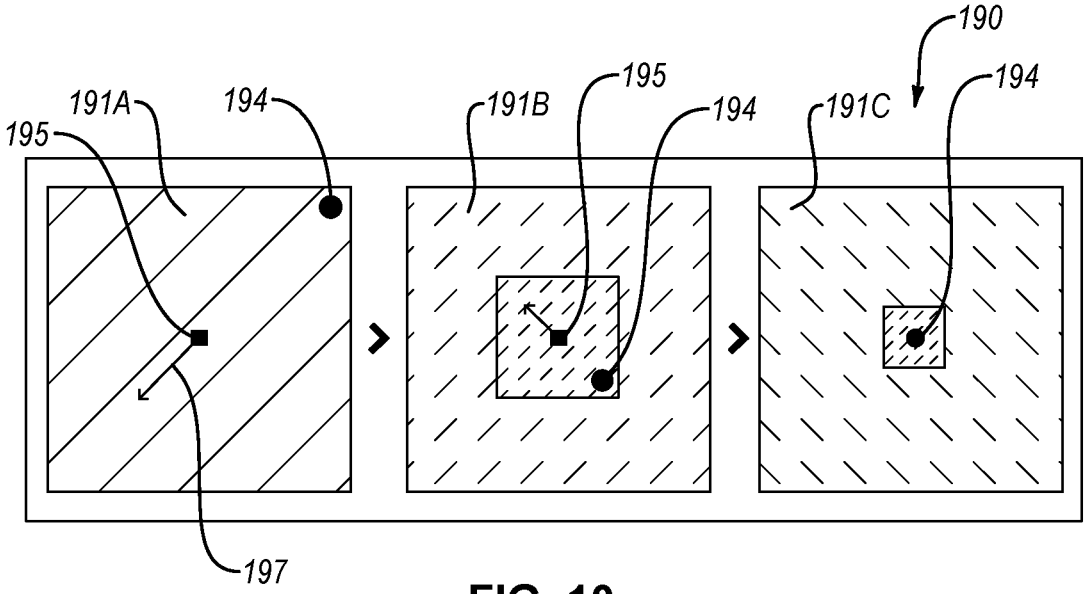
FIG. 10 is a schematic representation of a graphical sensor-module adjustment guide of a graphical user interface, according to one or more examples of the present disclosure.

In some examples, such as shown in FIG. 10, the graphical user interface 106 includes (e.g., displays) a graphical sensor-module adjustment guide 190 that helps an operator adjust the attachment of the sensor module 120 on the shaft 112. FIG. 10 shows three modes of the graphical sensor-module adjustment guide 190. In the first mode 191A, which is associated with a relatively large discrepancy between a sensed position 194 of the sensor module 120 and a target starting position 195 of the sensor module 120, a directional arrow 197, indicating a direction and magnitude of adjustment of the position of the sensor module 120 needed to reach the target starting position 195, is relatively long. Additionally, in the first mode 191A, a background color of the graphical sensor-module adjustment guide 190 is selected to correspond with the large discrepancy (e.g., red). In the second mode 191B, which is associated with a medium discrepancy between the sensed position 194 of the sensor module 120 and the target starting position 195 of the sensor module 120, the directional arrow 197 has a medium length. Additionally, in the second mode 191B, the background color of the graphical sensor-module adjustment guide 190 is selected to correspond with the medium discrepancy (e.g., yellow). In the third mode 191C, which is associated with a relatively small discrepancy between the sensed position 194 of the sensor module 120 and the target starting position 195 of the sensor module 120, the directional arrow 197 has a relatively short length. Additionally, in the third mode 191C, the background color of the graphical sensor-module adjustment guide 190 is selected to correspond with the relatively small discrepancy (e.g., green). It is also recognized, that a target box, sized according to the size of the discrepancy, containing the sensed position 194 of the sensor module 120, and having the same but a less transparent color than the background of the screen, can be incorporated into the graphical sensor-module adjustment guide 190 to provide a useful and quickly understood visualization of the progress being made to properly position the sensor module 120 on the shaft 112. The target starting position 195 is determined based on a known lie and loft of the golf club head 114 as determined by the clamping assembly 124.

After a proper position of the sensor module 120 on the shaft 112 is confirmed, the golf club head 114 is properly clamped by the clamping assembly 124, and the bending tool 139 is properly attached to the hosel 118, the method of bending the golf club head 114 includes moving the bending tool 139 to bend the hosel 118 relative to the strike face 115. The operator moves the bending tool 139, to bend the hosel 118, until the golf club head 114 has the desired loft and/or the desired lie. Whether the golf club head 114 has the desired loft and/or the desire lie can be confirmed based on sensor input received from the sensor module 120. According to one example, the sensor or sensors of the sensor array 159 detect a new position of the hosel 118 as the hosel is bent and the electronic controller 111 determines, via geometric relationships, a change in the loft and/or lie of the golf club head 114 based on a difference between the initial position of the sensor module 120, before the hosel 118 is bent, and a current position of the sensor module 120, after the hosel 118 is bent. The detection of the position of the hosel 118 and the determination of the change in the loft and/or lie of the golf club head 114 are done in real-time as the hosel 118 is bent by the bending tool 139.

As mentioned above, according to some examples, the hosel 118 is bent manually using the bending tool 139. However, in one example, the bending of the hosel 118 is automatedly controlled by the electronic controller 111 so that the bending of the golf club head 114 from an initial loft and lie to an adjusted or desired loft and lie is done automatically via automatic actuation of one or more bending actuators. However, in yet another example, actuation of one or more bending actuators is controlled manually by an operator via user-engagement controls or hardware.

Figure 11:
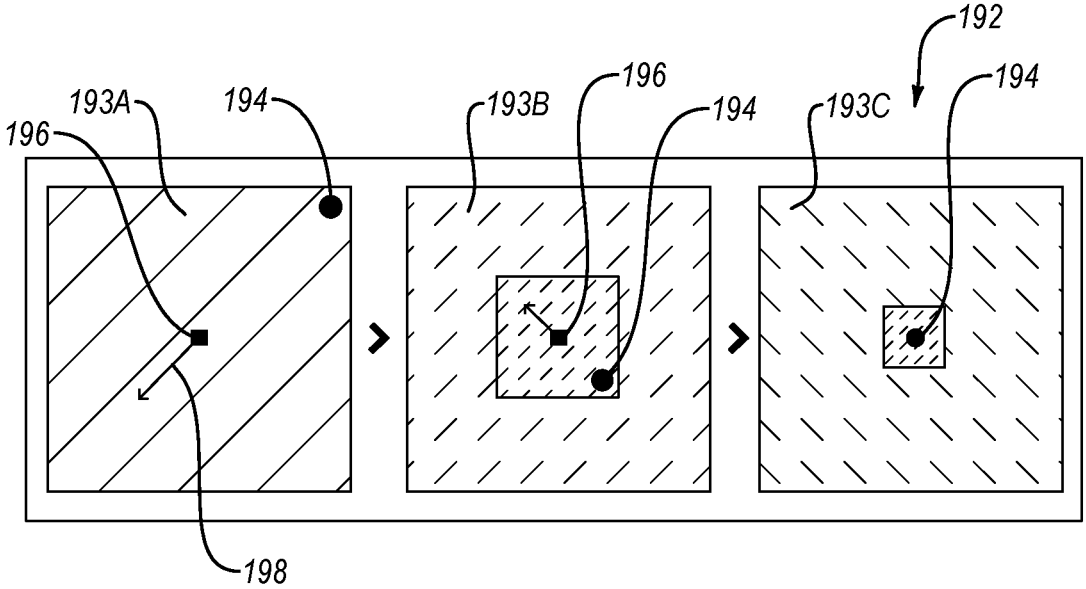
FIG. 11 is a schematic representation of a graphical hosel adjustment guide of a graphical user interface, according to one or more examples of the present disclosure.

Referring to FIG. 11, in some examples, the graphical user interface 106 includes a graphical hosel adjustment guide 192 that graphically indicates the current bend of the hosel 118 (i.e., current loft and lie of the golf club head 114) relative to a target bend of the hosel 118 (i.e., target loft and lie of the golf club head 114). When the hosel 118 is bent automatically, the graphical hosel adjustment guide 192 helps to show the progress of the bend. When the bending of the hosel 118 is controlled manually by an operator, the graphical hosel adjustment guide 192 helps the operator adjust the lie and/or loft of the golf club head 114 into the desired lie and/or loft.

Similar to the graphical sensor-module adjustment guide 190 of FIG. 10, the graphical hosel adjustment guide 192 shows three modes. In the first mode 193A, which is associated with a relatively large discrepancy between a sensed position 194 of the sensor module 120 (e.g., a sensed position of the hosel 118 or sensed lie and loft of the golf club head 114) and a target final position 196 of the sensor module 120 (e.g., a desired position of the hosel 118 or a desired lie and loft of the golf club head 114) position or desired, a directional arrow 198, indicating a direction and magnitude of adjustment of the position of the sensor module 120 needed to reach the target final position 196, is relatively long. Additionally, in the first mode 193A, a background color of the graphical sensor-module adjustment guide 190 is selected to correspond with the large discrepancy (e.g., red). In the second mode 193B, which is associated with a medium discrepancy between the sensed position 194 of the sensor module 120 and the target final position 196 of the sensor module 120, the directional arrow 198 has a medium length. Additionally, in the second mode 193B, the background color of the graphical hosel adjustment guide 192 is selected to correspond with the medium discrepancy (e.g., yellow). In the third mode 193C, which is associated with a relatively small discrepancy between the sensed position 194 of the sensor module 120 and the target final position 196 of the sensor module 120, the directional arrow 198 has a relatively short length. Additionally, in the third mode 193C, the background color of the graphical sensor-module adjustment guide 190 is selected to correspond with the relatively small discrepancy (e.g., green). It is also recognized, that a target box, sized according to the size of the discrepancy, containing the sensed position 194 of the sensor module 120, and having the same but a less transparent color than the background of the screen, can be incorporated into the graphical hosel adjustment guide 192 to provide a useful and quickly understood visualization of the progress being made to adjust the lie and/or loft of the golf club head 114 into the desired lie and/or loft of the golf club head 114.

Figure 12:
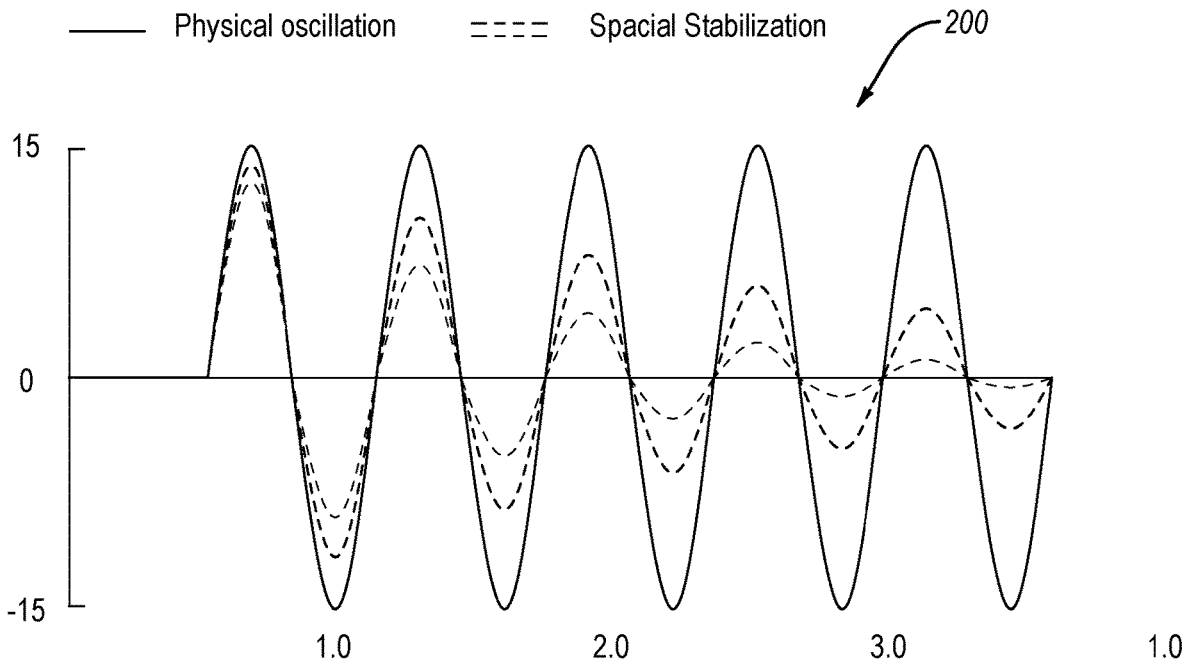
FIG. 12 is a graphical illustration of a spatial stabilization feature of a controller of a golf club head bending system, according to one or more examples of the present disclosure.

As the golf club head 114 is bent, the shaft 112 of the golf club 110 may have a tendency to wobble. Such wobbling affects the readings of the position of the shaft 112 (e.g., translated into the position of the hosel 118) from the sensor array 159. Referring to the chart 200 of FIG. 12, according to one example, the shaft 112 can experience physical oscillations as the hosel 118 is bent. In some examples, the electronic controller 111 of the bending system 100 includes a spatial stabilization feature that promotes more accurate readings from the sensor array 159 by compensating for physical oscillations of the shaft 112. In one example, the spatial stabilization feature simulates a cancellation force, which, when applied to the readings from the sensor array 159 reduces the intensity of the physical oscillations, such that the readings from sensor array 159 are closer to static readings.

Figure 13:
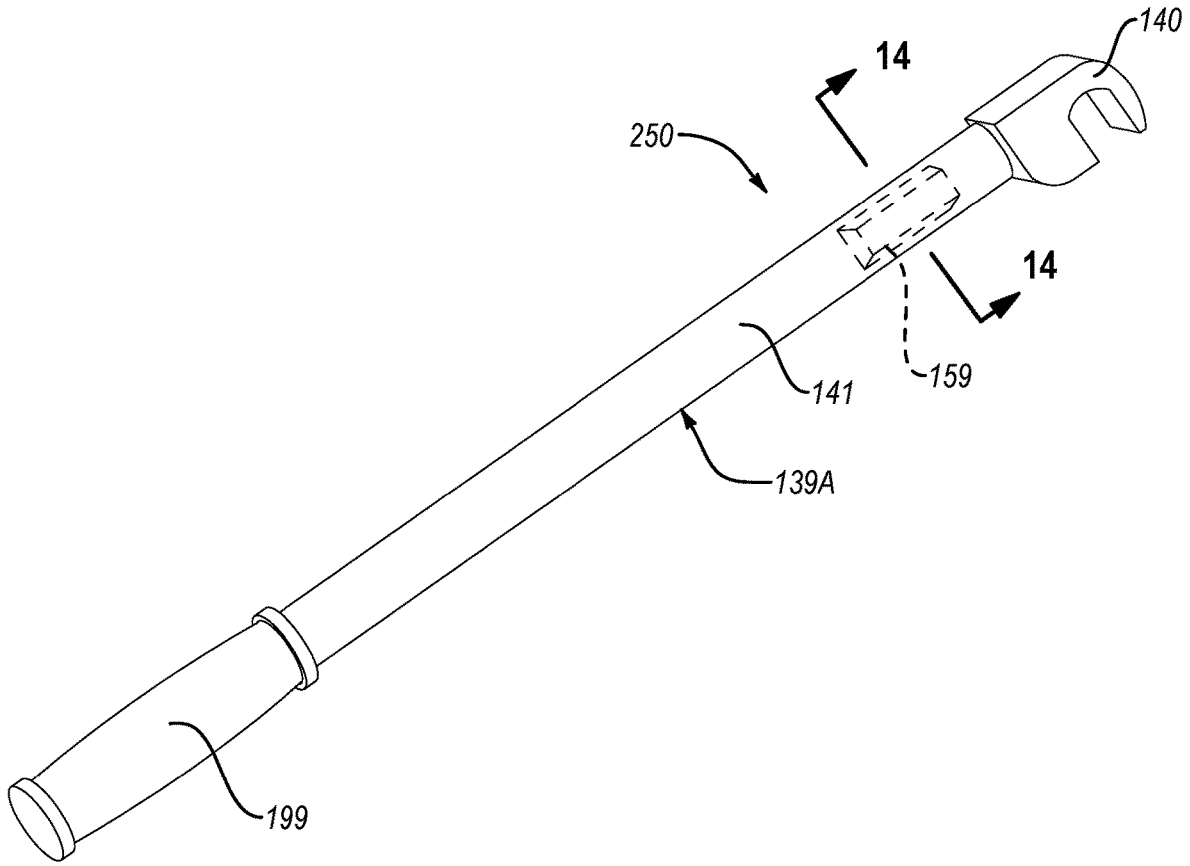
FIG. 13 is a perspective view of a bending tool of a golf club head bending system, according to one or more examples of the present disclosure.
Figure 15:
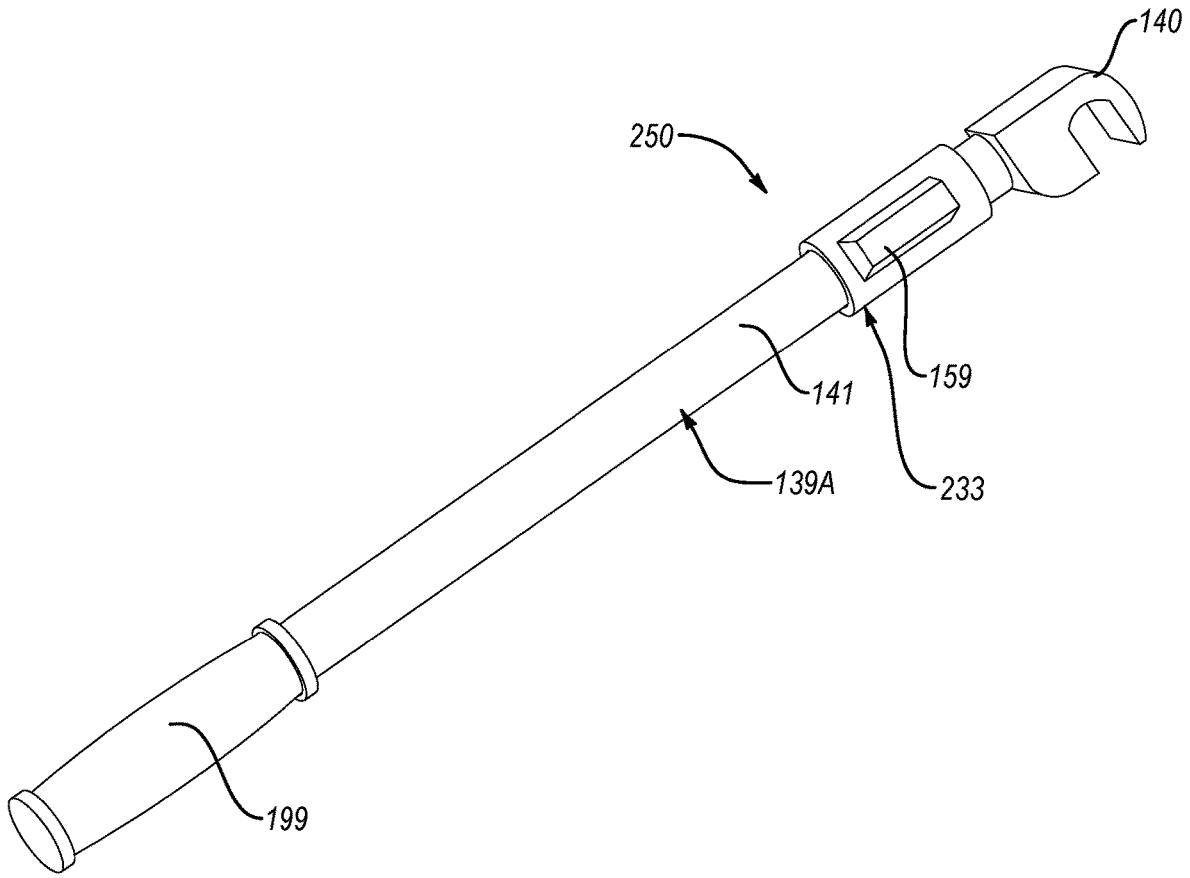
FIG. 15 is a perspective view of a bending tool of a golf club head bending system, according to one or more examples of the present disclosure.

Referring to FIGS. 13 and 15, in some examples, the position sensing device 250 of the bending system 100 is a bending tool 139A. In such examples, the bending tool 139A includes a sensor array 159, which can include features as defined above. Accordingly, the sensors of the sensor array 159 are fixed (i.e., do not move) relative to the bar 141 and the bit 140 of the bending tool 139A, and thus the sensors of the sensor array 159 move when the bending tool 139A is moved. Because the bending tool 139A includes the sensor array 159, the bending tool (139A) can be considered a smart bending tool.

Figure 14:
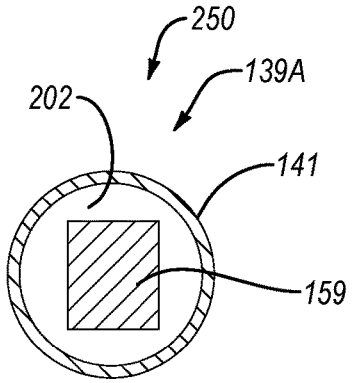
FIG. 14 is a front cross-sectional view of the bending tool of FIG. 13, taken along the line 14-14 of FIG. 13, according to one or more examples of the present disclosure.

As shown in FIGS. 13 and 14, in certain examples, the sensor array 159 is housed within the bar 141 of the bending tool 139A. The bar 141 can be hollow or at least partially hollow so that at least a portion of the bar 141 defines an interior cavity 202 of the bar 141. The sensor array 159 is located and fixed within the interior cavity 202 in these examples. In one example, the bar 141 includes a mounting feature formed in the interior cavity 202 and configured to receive and secure the sensor array 159. By being located within and housed by the bar 141, the bar 141 provides protection of the sensor array 159 from drops of or impacts to the bending tool 139A. The bending tool 139A can include a grip 199 attached to an end portion of the bar 141 that is opposite the end portion of the bar 141 to which the bit 140 is attached. In certain examples, the sensor array 159 is closer to the bit 140 than the grip 199. However, in other examples, the sensor array 159 is closer to the grip 199 than the bit 140.

Referring to FIG. 15, in other examples, instead of being located within the bar 141, the sensor array 159 is attached to an exterior of the bar 141 of the bending tool 139A. For example, the bending tool 139A can include an exterior mount 233 or attachment that is attached to the exterior of the bar 141. In one example, the exterior mount 233 is at least one of slid onto, clamped onto, fastened to, co-formed with, or co-molded with the exterior of the bar 141. The exterior mount 233 houses, or otherwise retains, the sensor array 159. In certain examples, the exterior mount 233 is closer to the bit 140 than the grip 199. However, in other examples, the exterior mount 233 is closer to the grip 199 than the bit 140.

Figure 18:
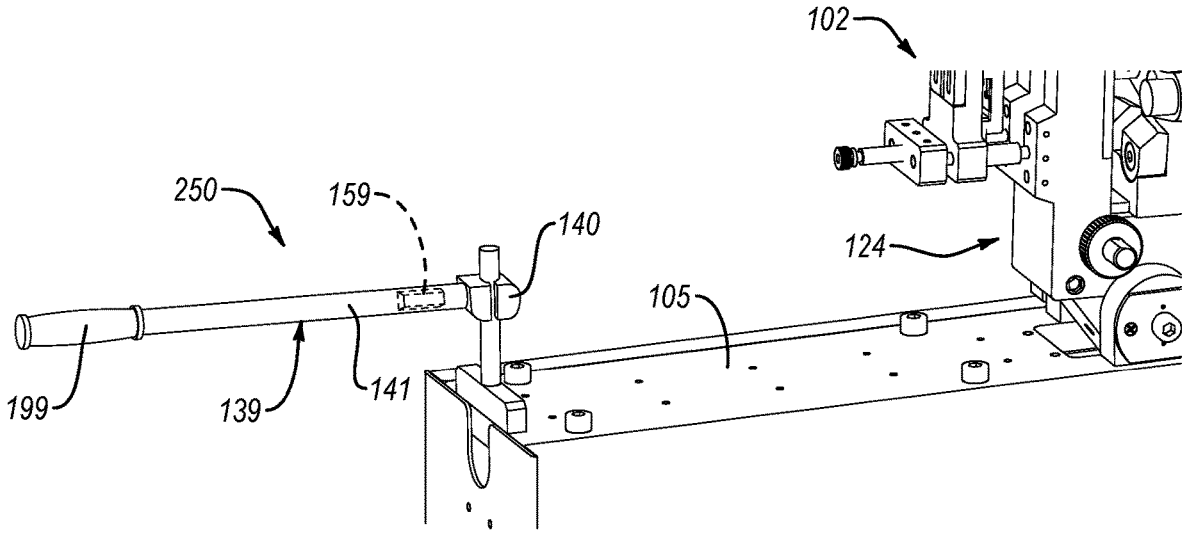
FIG. 18 is a perspective view of a sensor-module calibration pin and the clamping assembly of a golf club head bending system, shown with a bending tool attached to the sensor-module calibration pin, according to one or more examples of the present disclosure.

Because the bending tool 139A is selectively attached to the hosel 118 of the golf club head 114 in preparation for bending the golf club head 114, and the position or orientation of the hosel 118 relative to the strike face 115 corresponds with the position or orientation of the shaft 112 (or pin) of the golf club 110, the position of the bending tool 139A when attached to the hosel 118, as detected by the sensor array 159 of the bending tool 139A, can be used to determine the location of the hosel 118 relative to the strike face 115, and thus the amount the hosel 118 is bent relative to the strike face 115, in the same manner as the sensor module 120. Accordingly, like the sensor module 120, the bending tool 139A can be calibrated, as part of the second calibration step, to set the home position of the bending tool 139A relative to the frame 105. Referring to FIG. 18, the bending tool 139A is set to the home position by attaching the bit 140 of the bending tool 139A to the calibration pin 122, which is in a fixed location on the frame 105. Although not shown, the calibration pin 122 can include a clocking feature, similar to or the same as the clocking feature 157, which ensures the bending tool 139A is attached to the calibration pin 122 in a predetermined position and orientation associated with the home position. When in the home position, the electronic controller 111 can set the position and orientation of the bending tool 139A (as sensed by the sensor array 159 of the bending tool 139), to the home position.

After the home position of the bending tool 139A is set, the bending tool 139A can be removed (e.g., detached) from the calibration pin 122, and, after the golf club head 114 is clamped by the clamping assembly 124, the bending tool 139A can be attached to the hosel 118 of the golf club head 114 (see, e.g., FIG. 19) in preparation for bending the golf club head 114. As the bending tool 139A is moved, the sensor array 159 of the bending tool 139A detects the motion of the bending tool 139 away from the home position and tracks the position the sensor array 159 relative to the 3-axis coordinate system and the orientation (e.g., angle) of the sensor array 159 relative to the orientation when in the home position. Accordingly, at any given position of the bending tool 139 away from the home position, the coordinates of the bending tool 139A on the 3-axis coordinate system and the orientation (e.g., angle) of the bending tool 139A are known. Thus, when the bending tool 139A is attached to the hosel 118, the sensor input received by the electronic controller 111 from the bending tool 139A can be used by the electronic controller 111 to determine an initial (e.g., pre-bent) position of the golf club head 114, an initial loft of the golf club head 114, and an initial lie of the golf club head 114.

In some examples, the initial loft and/or the initial lie of the golf club head 114, as detected by the bending tool 139A, are compared against the loft and/or the lie of the golf club head 114, as determined by the position of the actuator 152 of the clamping assembly 124 or by the clamping-assembly sensor module 120C, to ensure the bending tool 139A is properly attached to the hosel 118. The initial loft and/or the initial lie of the golf club head 114, as detected by the bending tool 139A, should be the same as the loft and/or the lie of the golf club head 114, as determined by the actuator 152 or by the clamping-assembly sensor module 120C. When the loft and/or the lie detected by the sensor module 120 and determined by the actuator 152 or by the clamping-assembly sensor module 120C are the same, proper attachment of the bending tool 139A to the hosel 118 can be confirmed. However, when the loft and/or the lie detected by the sensor module 120 and determined by the actuator 152 or by the clamping-assembly sensor module 120C are different, the bending tool 139A is not attached properly. Adjustment of the bending tool 139A on the hosel 118 can be made until the loft and/or the lie detected by the sensor module 120 and determined by the actuator 152 or by the clamping-assembly sensor module 120C are the same.

Figure 16:
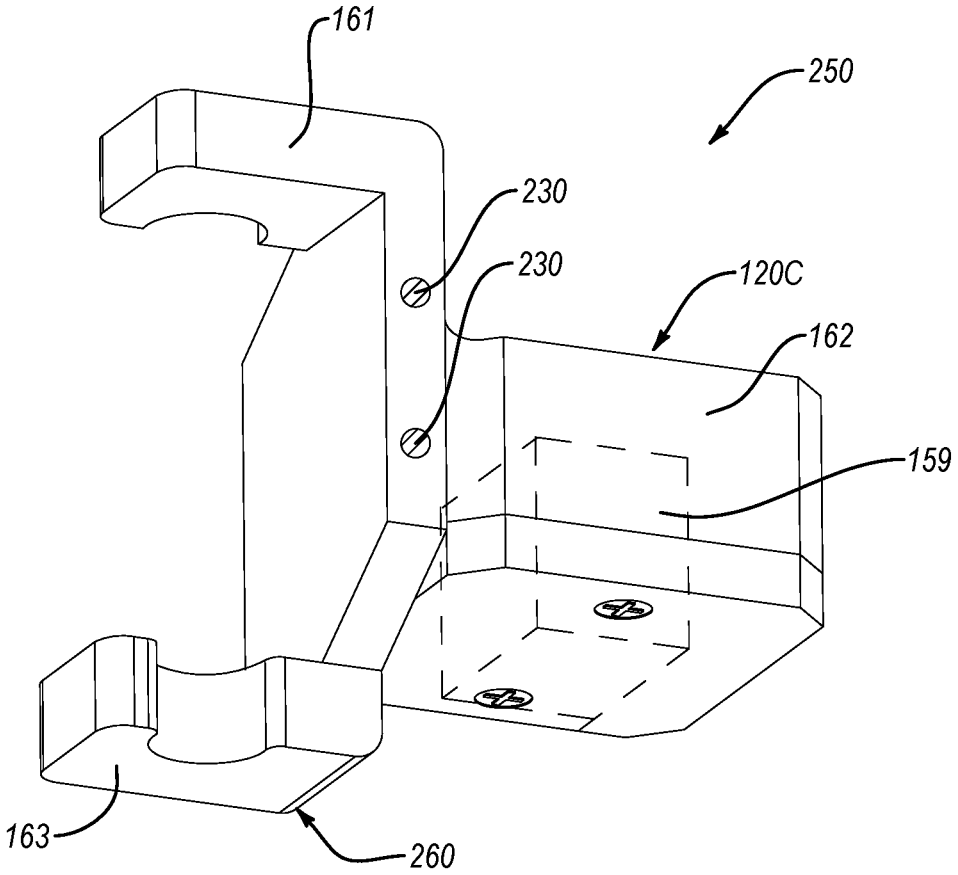
FIG. 16 is a perspective view of a sensor module of a golf club head bending system, according to one or more examples of the present disclosure.

Referring to FIG. 16, in some examples, the position sensing device 250 of the bending system 100 is the clamping-assembly sensor module 120C. The clamping-assembly sensor module 120C is similar to the sensor module 120. For example, the clamping-assembly sensor module 120C includes a pin attachment portion 260 that is configured to be temporarily attached to the sensor-module calibration pin 122. The pin attachment portion 260, like the shaft attachment portion 160 of the sensor module 120, includes a first retention arm 161 and a second retention arm 163. The clamping-assembly sensor module 120C includes a sensor portion 162, similar to the sensor portion 162 of the sensor module 120. The sensor portion 162 of the clamping-assembly sensor module 120C includes a sensor array 159. However, unlike the sensor module 120, the clamping-assembly sensor module 120C includes a clamping-assembly engagement feature configured to engage and be retained by a corresponding feature on the clamping assembly 124.

Engagement between the clamping-assembly engagement feature and the corresponding feature on the clamping assembly 124 temporarily secures the clamping-assembly sensor module 120C to the clamping assembly 124, so that the clamping-assembly sensor module 120C co-moves with the clamping assembly 124 relative to the frame 105. In the illustrated example, the clamping-assembly engagement feature includes a pair of apertures 230 formed in a base of the pin attachment portion 260, and the corresponding feature on the clamping assembly 124 includes a pair of pins 232 on the main body 125 of the clamping assembly 124. The pair of pins 232 are received into the pair of apertures 230 to temporarily secure the clamping-assembly sensor module 120C to the main body 125. Although in the illustrated examples the engagement feature of the clamping-assembly sensor module 120C is a pair of apertures 230 formed in the base of the pin attachment portion 260 and the corresponding engagement feature of the clamping assembly 124 is a pair of pins 232 on the main body 125, in other examples, the engagement feature of the clamping-assembly sensor module 120C can be any of various types of engagement features located on any of various portions of the clamping-assembly sensor module 120C and the corresponding engagement feature of the clamping assembly 124 can be any of various types of engagement features located on any of various portions of the clamping assembly 124, as long as engagement between the engagement features help to temporarily secure the clamping-assembly sensor module 120C to the clamping assembly 124. For example, although not shown, the engagement feature of the clamping-assembly sensor module 120C can be the first retention arm 161 and a second retention arm 163, and the corresponding engagement feature of the clamping assembly 124 can be a pin, like the sensor-module calibration pin 122.

Figure 17:
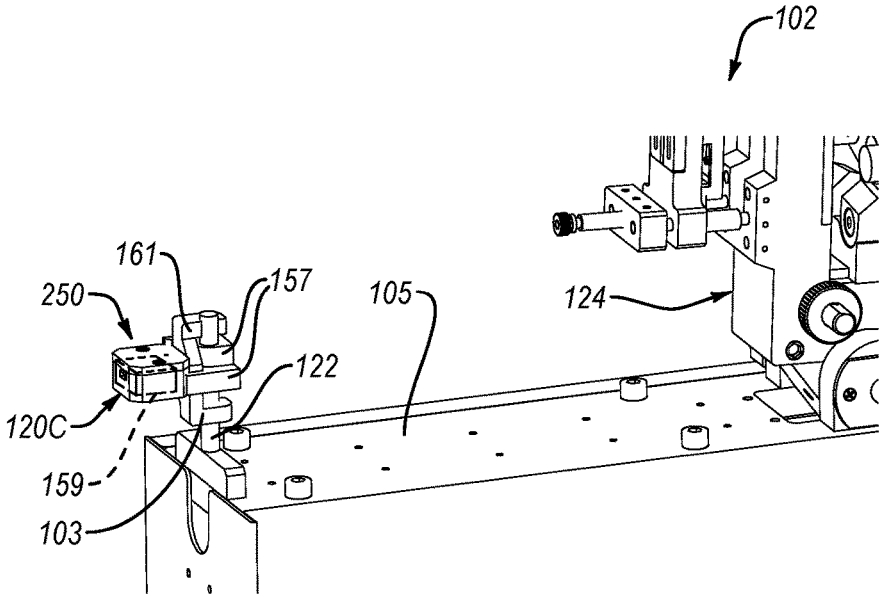
FIG. 17 is a perspective view of a sensor-module calibration pin and the clamping assembly of a golf club head bending system, shown with a sensor module, configured to be attached to the clamping assembly, attached to the sensor-module calibration pin, according to one or more examples of the present disclosure.

Because the position or orientation of the clamping assembly 124 relative to the frame 105 corresponds with the position or orientation of the flat interface surface 129 of the pre-clamp magnet of the clamping assembly 124, which indicates the loft angle of the strike face 115 of the golf club head 114 when attached to the flat interface surface 129, the position of the clamping-assembly sensor module 120C, when attached to the clamping assembly 124, as detected by the sensor array 159 of the clamping-assembly sensor module 120C can be used to determine the location of the strike face 115 and the location of the hosel 118 relative to the strike face 115. This can be helpful to ensure the golf club head 114 is in a predicted position or in the correct bending position before bending of the golf club head 114 is performed. Like the sensor module 120, the clamping-assembly sensor module 120C can be calibrated, as part of the second calibration step, to set the home position of the clamping-assembly sensor module 120C relative to the frame 105. Referring to FIG. 17, the clamping-assembly sensor module 120C is set to the home position by attaching the first retention arm 161 and the second retention arm 163 of the pin attachment portion 260 to the calibration pin 122. The clocking feature 157 can be used to ensure the clamping-assembly sensor module 120C is attached to the calibration pin 122 in a predetermined position and orientation associated with the home position. When in the home position, the electronic controller 111 can set the position and orientation of the clamping-assembly sensor module 120C (as sensed by the sensor array 159 of the clamping-assembly sensor module 120C), to the home position.

After the home position of the clamping-assembly sensor module 120C is set, the clamping-assembly sensor module 120C can be removed (e.g., detached) from the calibration pin 122, and the clamping-assembly sensor module 120C can be attached to clamping assembly 124 (see, e.g., FIG. 19) in preparation for bending the golf club head 114. As the clamping-assembly sensor module 120C is moved, the sensor array 159 of the clamping-assembly sensor module 120C detects the motion of the clamping-assembly sensor module 120C away from the home position and tracks the position the sensor array 159 relative to the 3-axis coordinate system and the orientation (e.g., angle) of the sensor array 159 relative to the orientation when in the home position. Accordingly, at any given position of the clamping-assembly sensor module 120C away from the home position, the coordinates of the clamping-assembly sensor module 120C on the 3-axis coordinate system and the orientation (e.g., angle) of the clamping-assembly sensor module 120C are known. Thus, when the clamping-assembly sensor module 120C is attached to the clamping assembly 124, the sensor input received by the electronic controller 111 from the clamping-assembly sensor module 120C can be used by the electronic controller 111 to determine a position of the clamping assembly 124 and thus a loft of the golf club head 114 and a corresponding position of the hosel 118.

In some examples, the position of the clamping assembly 124, as detected by the clamping-assembly sensor module 120C, is compared against a desired or predicted position (e.g., the desired bending position) of the clamping assembly 124 associated with a desired position of the golf club head 114 for bending. The detected position of the clamping assembly should be the same as the desired or predicted position of the clamping assembly 124. When they are not the same, the position of the clamping assembly 124 can be adjusted, such as via the actuator 152, until it is the same as the desired or predicted position of the clamping assembly 124.

Figure 19:
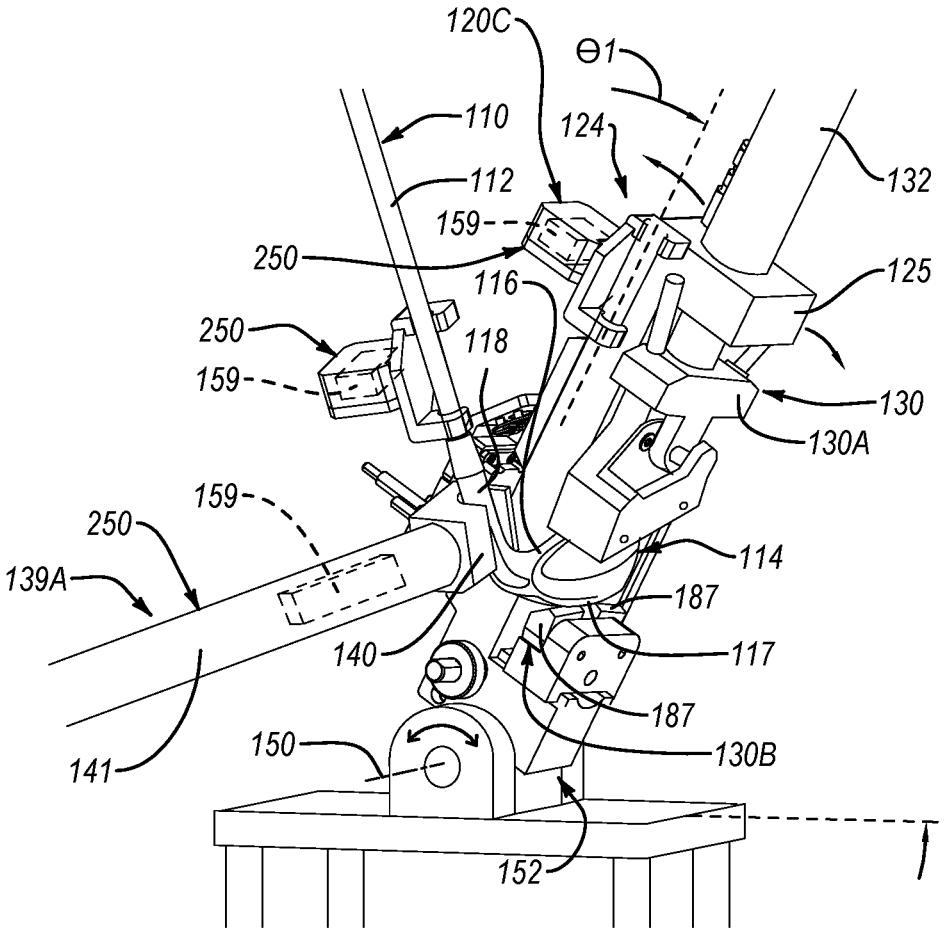
FIG. 19 is a perspective view of a golf club head bending system, shown with a golf club head clamped by the bending system and a bending tool engaged with a hosel of the golf club head, according to one or more examples of the present disclosure.

The golf club head bending system 100 includes at least one position sensing device 250. In some examples, the golf club head bending system 100 includes only one position sensing device 250, which can be any one of the sensor module 120, the clamping-assembly sensor module 120C, or the bending tool 139A. Each one of the sensor module 120, the clamping-assembly sensor module 120C, and the bending tool 139A can be used to provide position data concerning the position of the golf club head 114 and/or the clamping assembly 124 for promoting accurate, precise, and efficient bending of the golf club head 114. However, accurate and precise bending of the golf club head 114 can be improved by combining or comparing position data from multiple position sensing devices 250. Accordingly, in certain examples, such as shown in FIG. 19, the golf club head bending system 100 includes at least two position sensing devices 250, which can be at least any two of the sensor module 120, the clamping-assembly sensor module 120C, or the bending tool 139A. For example, values for the position of the golf club head 114, as determined from data procured by the at least two position sensing devices 250, can be averaged to determine an average position of the golf club head 114. The average position of the golf club head 114 is utilized by the electronic controller 111 to identify the position of the golf club head 114 relative to the frame 105 and/or to identify the change in the loft and/or lie of the golf club head 114 when undergoing a bending process. In yet other examples, as shown in FIG. 19, for even more precision and accuracy, the golf club head bending system 100 includes three position sensing devices 250, which can include each one of the sensor module 120, the clamping-assembly sensor module 120C, or the bending tool 139A.

According to some examples, the position of the golf club head 114 relative to the frame 105 and the amount the golf club head 114 has been bent can be determined by triangulating the positions of multiple position sensing devices 250, relative to the frame 105, such as the individual positions of the sensor module 120, the clamping-assembly sensor module 120C, and the bending tool 139A.

Figure 20:
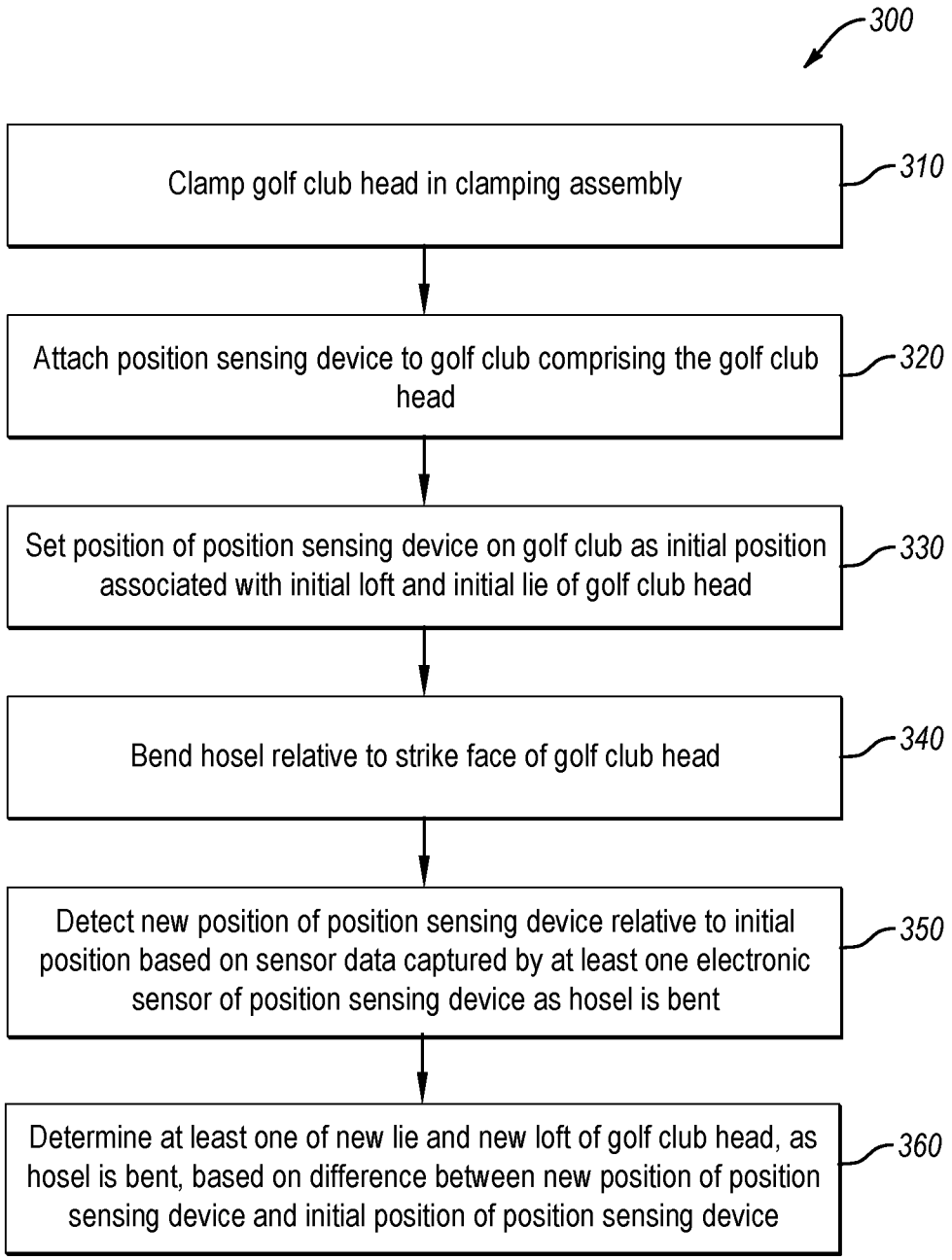
FIG. 20 is a schematic flow chart of a method of bending a golf club head, according to one or more examples of the present disclosure.

In view of the foregoing, and according to one example shown in FIG. 20, disclosed herein is a method 300 of bending a golf club head, such as the golf club head 114. The method 300 includes (block 310) clamping the golf club head 114 in the clamping assembly 124 and (block 320) attaching the position sensing device 250 to the golf club 110. The method 300 also includes (block 330) setting a position of the position sensing device 250 on the golf club 110 as an initial position associated with an initial loft and an initial lie of the golf club head 114. The method 300 additionally includes (block 340) bending the hosel 118 relative to the strike face 115 of the golf club head 114 and (block 350) detecting a new position of the position sensing device 250 relative to the initial position based on sensor data captured by at least one electronic sensor of the position sensing device 250 as the hosel 118 is bent. Finally, the method 300 includes (block 360) determining at least one of a new lie and a new loft of the golf club head 114, as the hosel 118 is bent, based on a difference between the new position of the position sensing device 250 and the initial position of the position sensing device 250.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

The term "about" or "substantially" in some embodiments, is defined to mean within +/−5% of a given value, however in additional embodiments any disclosure of "about" may be further narrowed and claimed to mean within +/−4% of a given value, within +/−3% of a given value, within +/−2% of a given value, within +/−1% of a given value, or the exact given value. Further, when at least two values of a variable are disclosed, such disclosure is specifically intended to include the range between the two values regardless of whether they are disclosed with respect to separate embodiments or examples, and specifically intended to include the range of at least the smaller of the two values and/or no more than the larger of the two values. Additionally, when at least three values of a variable are disclosed, such disclosure is specifically intended to include the range between any two of the values regardless of whether they are disclosed with respect to separate embodiments or examples, and specifically intended to include the range of at least the A value and/or no more than the B value, where A may be any of the disclosed values other than the largest disclosed value, and B may be any of the disclosed values other than the smallest disclosed value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first" "second" etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The electronic controller and associated modules described in this specification may be implemented as a hardware circuit comprising custom VLSI circuits or gate arrays, off-the-shelf semiconductors such as logic chips, transistors, or other discrete components. The electronic controller may also be implemented in programmable hardware devices such as field programmable gate arrays, programmable array logic, programmable logic devices or the like.

The electronic controller may also be implemented in code and/or software for execution by various types of processors. An identified module of code may, for instance, comprise one or more physical or logical blocks of executable code which may, for instance, be organized as an object, procedure, or function. Nevertheless, the executables of the electronic controller need not be physically located together, but may comprise disparate instructions stored in different locations which, when joined logically together, comprise the electronic controller and achieve the stated purpose for the electronic controller.

Indeed, code of the electronic controller may be a single instruction, or many instructions, and may even be distributed over several different code segments, among different programs, and across several memory devices. Similarly, operational data may be identified and illustrated herein within the electronic controller, and may be embodied in any suitable form and organized within any suitable type of data structure. The operational data may be collected as a single data set, or may be distributed over different locations including over different computer readable storage devices. Where the electronic controller or portions of the electronic controller are implemented in software, the software portions are stored on one or more computer readable storage devices.

Any combination of one or more computer readable medium may be utilized. The computer readable medium may be a computer readable storage medium. The computer readable storage medium may be a storage device storing the code. The storage device may be, for example, but not limited to, an electronic, magnetic, optical, electromagnetic, infrared, holographic, micromechanical, or semiconductor system, apparatus, or device, or any suitable combination of the foregoing.

More specific examples (a non-exhaustive list) of the storage device would include the following: an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Code for carrying out operations for embodiments may be written in any combination of one or more programming languages including an object oriented programming language such as Python, Ruby, Java, Smalltalk, C++, or the like, and conventional procedural programming languages, such as the "C" programming language, or the like, and/or machine languages such as assembly languages. The code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example the Internet using an Internet Service Provider).

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described embodiments are to be considered in all respects only as illustrative and not restrictive. All changes which come within the meaning and range of equivalency of the examples below are to be embraced within their scope.

What is claimed is:

1. A bending system for bending a golf club head, the bending system comprising:

a clamping assembly, configured to clamp the golf club head;

a position sensing device, selectively attachable to a golf club, wherein the position sensing device comprises a sensor array comprising an accelerometer and a gyroscope; and an electronic controller, configured to determine at least one of a lie or a loft of the golf club head, when the position sensing device is selectively attached to the golf club and the golf club head is clamped by the clamping assembly, based at least partially on sensor data received from the accelerometer and the gyroscope.

2. The bending system according to claim 1, wherein the clamping assembly comprises a pre-clamp magnet configured to magnetically attach to a strike face of the golf club head.

3. The bending system according to claim 2, wherein the clamping assembly further comprises:

a primary clamp, configured to clamp the golf club head at a topline portion and a sole of the golf club head when the strike face is magnetically attached to the pre-clamp magnet; and a secondary clamp, configured to clamp the golf club head at a rearward portion and the strike face when the strike face is magnetically attached to the pre-clamp magnet.

4. The bending system according to claim 3, wherein the primary clamp comprises two sole-support pads that support the sole of the golf club head when the strike face is magnetically attached to the pre-clamp magnet, and that are movable relative to the pre-clamp magnet to accommodate a size and/or a shape of the sole of the golf club head.

5. The bending system according to claim 4, wherein the two sole-support pads are translationally movable toward and away from the pre-clamp magnet.

6. The bending system according to claim 3, wherein:

the primary clamp comprises a first jaw, which supports the topline portion of the golf club head, and a second jaw, which supports the sole of the golf club head; and the first jaw is pivotable and translationally movable toward and away from the second jaw.

7. The bending system according to claim 3, wherein the secondary clamp comprises:

an end plate;

elastomeric pads spaced apart from each other and fixed to the end plate;

an actuator; and a pliable coupling that couples the actuator to the end plate.

8. The bending system according to claim 2, wherein:

the clamping assembly further comprises a camera assembly;

the pre-clamp magnet comprises an aperture through which a portion of the strike face is viewable when the strike face is magnetically attached to the pre-clamp magnet; and the camera assembly is configured to capture an image of the portion of the strike face viewable through the aperture.

9. The bending system according to claim 8, wherein the electronic controller is configured to determine whether the golf club head is squarely attached to the pre-clamp magnet based on the image captured by the camera assembly.

10. The bending system according to claim 1, wherein:

the clamping assembly comprises a toe stop configured to engage a toe of the golf club head when the golf club head is clamped by the clamping assembly; and the toe stop is movable in a direction parallel to a heel-to-toe direction of the golf club head.

11. The bending system according to claim 1, wherein:

the position sensing device comprises a sensor module that is selectively attachable to a shaft of the golf club head at a location proximate a hosel of the golf club head; and the sensor module comprises a shaft attachment portion that is configured to attach to the shaft with a snap fit.

12. The bending system according to claim 11, wherein:

the shaft attachment portion comprises a first retention arm and a second retention arm; and when the shaft attachment portion is attached to the shaft, the first retention arm is spaced apart from the second retention arm along a central axis of the shaft.

13. The bending system according to claim 12, wherein each one of the first retention arm and the second retention arm comprises a shaft retention channel.

14. The bending system according to claim 13, wherein the second retention arm is oppositely oriented relative to the first retention arm.

15. The bending system according to claim 14, wherein the first retention arm and the second retention arm are flexible relative to each other.

16. The bending system according to claim 11, wherein the sensor array is fixed relative to the shaft attachment portion.

17. The bending system according to claim 1, wherein the sensor array further comprises a magnetometer.

18. The bending system according to claim 1, wherein the position sensing device comprises a wireless transceiver that is configured to wirelessly transmit the sensor data to the electronic controller.

19. The bending system according to claim 1, wherein:

the position sensing device further comprises an onboard power source and the accelerometer and the gyroscope are powered from electrical energy received from the onboard power source;

the position sensing device captures the sensor data and the electronic controller determines the at least one of the lie and the loft of the golf club head in real time as a hosel of the golf club head is bent relative to a strike face of the golf club head by the bending system; and the bending system further comprises a graphical user interface configured to display a current position of the position sensing device in real time relative to a target position of the position sensing device.

20. The bending system according to claim 1, wherein:

the position sensing device comprises a bending tool;

the bending tool comprises a bar and a bit attached to an end of the bar;

the bit is configured to engage and retain a hosel of the golf club head; and the sensor array is attached to the bar of the bending tool.

21. The bending system according to claim 20, wherein:

the bar comprises a hollow portion that defines an interior cavity; and the sensor array is within the interior cavity.

22. The bending system according to claim 1, further comprising a clamping-assembly sensor module that is selectively attachable to the clamping assembly and comprises a second sensor array having an accelerometer and a gyroscope.

23. The bending system according to claim 1, wherein:

the bending system comprises a plurality of position sensing devices;

one of the plurality of position sensing devices comprises a sensor module that is selectively attachable to a shaft of the golf club head at a location proximate a hosel of the golf club head, wherein the sensor module comprises a shaft attachment portion that is configured to attach to the shaft with a snap fit; and another one of the plurality of position sensing devices comprises a bending tool that comprises a bar and a bit attached to an end of the bar, wherein the bit is configured to engage and retain a hosel of the golf club head, and wherein the sensor array is attached to the bar of the bending tool.

* * * * *